US010978290B1

(12) United States Patent
Coe-Sullivan et al.

(10) Patent No.: US 10,978,290 B1
(45) Date of Patent: Apr. 13, 2021

(54) ULTRAVIOLET FIELD-EMISSION LAMPS AND THEIR APPLICATIONS

(71) Applicant: NS Nanotech, Inc., Ann Arbor, MI (US)

(72) Inventors: Seth Coe-Sullivan, Redondo Beach, CA (US); Matthew Stevenson, Ann Arbor, MI (US); David Arto Laleyan, Whitmore Lake, MI (US)

(73) Assignee: NS Nanotech, Inc., Ann Arbor, MI (US)

( * ) Notice: Subject to any disclaimer, the term of this patent is extended or adjusted under 35 U.S.C. 154(b) by 0 days.

(21) Appl. No.: 17/009,669

(22) Filed: Sep. 1, 2020

Related U.S. Application Data

(60) Provisional application No. 63/071,810, filed on Aug. 28, 2020.

(51) Int. Cl.
*H01J 61/04* (2006.01)
*H01J 61/98* (2006.01)
*H01J 61/30* (2006.01)

(52) U.S. Cl.
CPC ..... *H01J 61/04* (2013.01); *H01J 61/98* (2013.01); *H01J 61/302* (2013.01)

(58) Field of Classification Search
CPC .. H01J 61/04; H01J 61/98; H01J 21/00; H01J 61/0672; H01J 61/0732; H01J 2893/0001
See application file for complete search history.

*Primary Examiner* — Donald L Raleigh

(57) ABSTRACT

Improved ultraviolet field-emission lamps can be safely deployed close to people because they eliminate the use of toxic materials, mitigate heating issues, and emit light in a wavelength range that is safe for human exposure.

30 Claims, 18 Drawing Sheets

ULTRAVIOLET FIELD-EMISSION LAMPS AND THEIR APPLICATIONS

RELATED U.S. APPLICATION

This application claims priority to the U.S. Provisional Application entitled "Synthesis and Use of Materials for Ultraviolet Field-Emission Lamps, and Ultraviolet Field-Emission Lamps and Their Applications," by S. Coe-Sullivan et al., Ser. No. 63/071,810, filed Aug. 28, 2020, hereby incorporated by reference in its entirety.

This application is related to the patent application entitled "Synthesis and Use of Materials for Ultraviolet Field-Emission Lamps," by S. Coe-Sullivan et al., Ser. No. 17/009,621, filed Sep. 1, 2020, hereby incorporated by reference in its entirety.

BACKGROUND

The hexagonal polymorph of boron nitride (h-BN) consists of a stacking of boron and nitrogen atoms, where the different layers are bonded by weak van der Waals forces. h-BN has high thermal conductivity but low electrical conductivity. This rare characteristic, and its strong chemical and thermal stability, make h-BN a very attractive material for many applications. h-BN powders are used in cosmetics and as a lubricant in extreme environments such as in space. They can also be pressed and shaped in the form of crucibles for high-temperature applications. More recently, h-BN has been shown to be useful as a light-emitting semiconductor. Owing to its wide bandgap, which is of comparable or higher energy than Al(Ga)N (aluminum nitride or aluminum gallium nitride), h-BN can be used to address some of the critical challenges of Al(Ga)N-based devices such as field-emission lamps (FELs).

The synthesis of commercially produced h-BN involves using a boric oxide or acid and a nitrogen-containing compound. Following this reaction, an annealing procedure is required to remove any residual oxide and to crystallize the obtained amorphous BN. The conventional synthesis methods of h-BN powders are facile but leave defects that cause undesirable and low-efficiency light emission. High-pressure and high-temperature methods create better h-BN material, but still introduce impurities inherent in the process. In addition, these methods produce small flakes that are difficult to spread onto a large area. Mechanical and chemical exfoliation techniques are well-established but are slow and of low yield. As a result, a high-throughput and low-cost, but higher quality and purity, process for the synthesis of light-emitting-grade h-BN, is lacking.

Ultraviolet (UV) FELs are of particular interest, especially UV-FELs that can operate in a wavelength range of approximately 200-230 nanometers (nm), because UV light in that wavelength range does not harm human skin but still has germicidal properties. Thus, UV-FELs that operate within that wavelength range can be deployed around people but can still be used for inactivating or killing bacteria and viruses (such as severe acute respiratory syndrome coronavirus 2 (SARS-CoV-2)) in the air and on surfaces in, for example, homes, offices, classrooms, and hospitals.

Known conventional sources of UV light that can be employed in the 200-230 nm range are problematic for a number of reasons. Existing lamps include a long tube containing krypton and chorine gas, which can pose a health hazard if the tube is broken. Additionally, these lamps are fragile and can be damaged by handling with bare hands, as oil from the skin can cause a failure in an operating lamp.

Finally, these tubes are very hot when operating, so much so that they cannot be deployed in applications that bring them close to people.

SUMMARY

Embodiments according to the present invention provide a solution to the problems described above.

Disclosed herein are improved ultraviolet field-emission lamps (UV-FELs) that can be safely deployed close to people because they eliminate the use of toxic materials, mitigate heating issues, and emit light in a wavelength range that is safe for human exposure. Also disclosed are apparatuses that utilize the improved UV-FELs to disinfect surfaces and objects to eliminate the causes of dangerous diseases, including SARS-COV-2, the coronavirus responsible for the Covid-19 pandemic.

In embodiments, a UV-FEL includes a first plate (e.g., a faceplate that includes or that can act as an anode) that includes a heat-conducting material (e.g., a metal), a second plate (e.g., a backplate) that includes a light-transmitting material, an emitter between the first plate and the second plate and that is a source of UV light, a light-reflective material between the emitter and the first plate, and a cathode between the emitter and the second plate, where the cathode has an opening or openings formed therein. In operation, the UV light from the emitter passes through the opening(s) and through the second plate.

In embodiments, substantially all of the UV light has a wavelength in a range of 200-230 nanometers (nm).

In embodiments, the operating temperature of the UV-FEL remains below 100 degrees Celsius (° C.). The operating temperature may also be less than 50° C. or even less than 35° C.

In embodiments, the emitter includes hexagonal boron nitride. In other embodiments, the emitter includes gallium nitride, aluminum nitride, aluminum gallium nitride, or indium aluminum gallium nitride.

These and other objects and advantages of the various embodiments of the present invention will be recognized by those of ordinary skill in the art after reading the following detailed description of the embodiments that are illustrated in the various drawing figures.

BRIEF DESCRIPTION OF DRAWINGS

The accompanying drawings, which are incorporated in and form a part of this specification and in which like numerals depict like elements, illustrate embodiments of the present disclosure and, together with the detailed description, serve to explain the principles of the disclosure. The drawings are not necessarily to scale.

DETAILED DESCRIPTION

Figure 1:
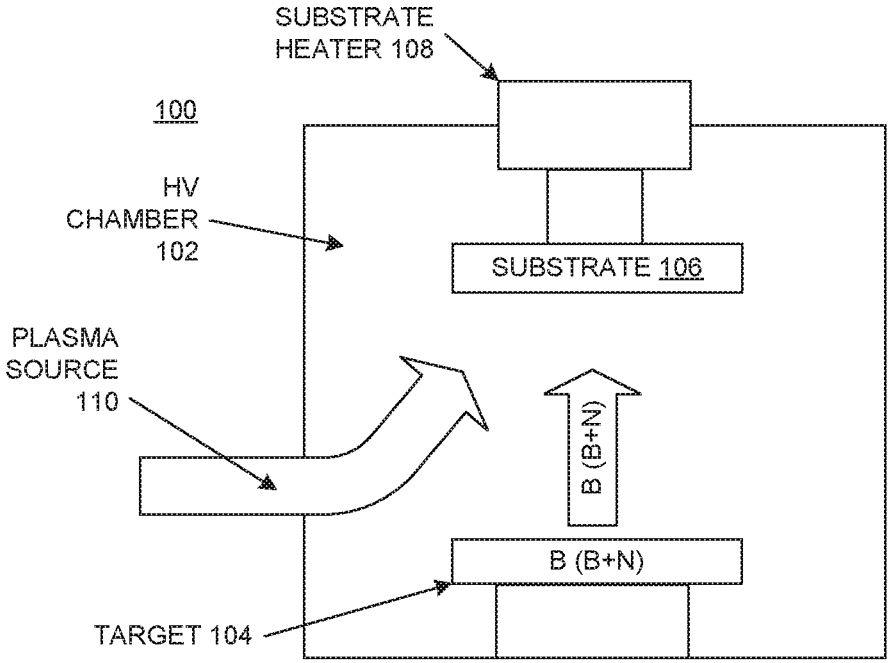
FIG. 1 illustrates a system or apparatus for performing a method of synthesizing hexagonal boron nitride (h-BN) in embodiments according to the present invention.

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The figures are not necessarily drawn to scale, and only portions of the devices and structures depicted, as well as the various layers that form those structures, are shown. For simplicity of discussion and illustration, only one or two devices or structures may be described, although in actuality more than one or two devices or structures may be present or formed. Also, while certain elements, components, and layers are discussed, embodiments according to the invention are not limited to those elements, components, and layers. For example, there may be other elements, components, layers, and the like in addition to those discussed.

Hexagonal Boron Nitride for Ultraviolet Light Emission

As mentioned previously herein, hexagonal boron nitride (h-BN) has been shown to be useful as a light-emitting semiconductor. Because of its wide bandgap, which is of comparable or higher energy than Al(Ga)N (aluminum nitride or aluminum gallium nitride), h-BN can be used to address some of the critical challenges of Al(Ga)N-based devices such as field-emission lamps (FELs).

As noted above, a successful far-UV germicidal FEL that is safe for humans requires an emission spectrum in the range of 200-230 nanometers (nm) without substantial additional emission in the rest of the UV spectral range. In the case of h-BN, this is achieved by maximizing the desirable emission range while minimizing, or ideally suppressing, the undesirable defect emissions greater than 250 nm. A ratio R can be used to define the intensity of desirable emission A over the intensity of undesirable emission B, where the value of R should be as high as possible: $R=A/B$.

In an ideal light-emitting semiconductor, radiative recombination is a result of a band-to-band (or excitonic) transition between an electron in the conduction band and a hole in the valance band, resulting in a photon being emitted with a wavelength corresponding to the bandgap (or exciton) energy. However, due to material imperfections, intermediate transitions can also occur.

Crystalline defects, such as point defects, dislocations, or stacking faults, can lead to trap states within the bandstructure that cause nonradiative recombination. Improving the material quality enhances radiative as opposed to nonradiative recombination (e.g., the internal quantum efficiency, IQE), resulting in a higher value of A. In the case of h-BN, this means forming proper bonds between the boron and nitrogen atoms, either during a controlled bottom-up growth approach (epitaxy) and/or by promoting a recrystallization of the existing material by thermal annealing.

Additionally, especially in wide-bandgap semiconductors where there is room within the bandgap for a variety of intermediate transitions, material imperfections can lead to radiative recombination resulting in a photon with an energy lower than that of the bandgap (or exciton). This guides the value of B. These intermediate transitions can occur between donor and/or acceptor levels, and defect states that originate from point defects such as impurities and vacancies.

In the case of h-BN, possible causes include oxygen and carbon impurities, as well as boron and nitrogen vacancies. To address the impurities, the starting materials are of the highest purity possible, avoiding compounds containing oxygen, hydrogen, and/or carbon. The synthesis environment is also void of such unwanted impurities, under ultra-high vacuum. Alternatively, an ultra-high purity nitrogen or inert gas (e.g., argon) environment is used. Although harder to control in practice, boron and/or nitrogen vacancies can be addressed by tuning the ratio of boron and nitrogen atoms during synthesis. While a one-to-one stoichiometry is desired for h-BN, this may actually require a higher amount of one element to be provided during growth. A complementary or alternative approach is refining the existing material by thermal annealing to force the correct type of atom to migrate into the vacancy site.

By both increasing the value of A and decreasing the value of B, the value of R can be maximized.

Lastly, while as discussed R is primarily dependent on the intrinsic material quality, the method and conditions of excitation may promote some charge carrier transitions more than others. For example, there may be differences in the emission spectrum obtained by photoluminescence, cathodoluminescence, and electroluminescence. Many defect/trap states can be suppressed at cryogenic temperatures and do not participate anymore in the recombination process. Some intermediate or excitonic transitions only occur at low excitation, while some emission peaks can only be observed under a high excitation regime. The surface and bulk of the material may also behave differently due to the presence of surface (generally nonradiative) states, so the emission profile may change by exciting the surface or bulk of the material. As a two-dimensional material, the bandstructure and therefore related properties of h-BN can change between monolayer, few layer, and bulk thicknesses.

Disclosed herein are high-throughput, low cost, high quality, and purity processes for the synthesis of light-emitting-grade h-BN that incorporate features including those described above, such as high-purity starting materials, ultra-high vacuum conditions, and recrystallization by annealing.

FIG. 1 illustrates a system or apparatus 100 for performing a method of synthesizing h-BN in some embodiments according to the present invention. The apparatus 100 includes a high-vacuum (HV) chamber 102, a source or target 104 inside the HV chamber, a substrate 106 inside the HV chamber, and a substrate heater 108. The source 104 includes boron or boron nitride. In an embodiment, the boron in the source 104 is high-purity (e.g., greater than 99 percent) or ultra-high purity (e.g., greater than 99.9 percent or even greater than 99.999 percent). The high-purity source boron is easily and cost-effectively obtained.

The substrate 106 is a high-temperature-tolerant substrate such as sapphire, silicon dioxide ($SiO_2$), or a metal such as nickel (Ni), copper (Cu), platinum (Pt), rubidium (Ru), rhodium (Rh), or cobalt (Co). In an embodiment, the apparatus 100 also includes a nitrogen plasma source 110 (e.g., a radio-frequency (RF) nitrogen plasma source) that can be directed toward the substrate 106. Methods of synthesizing h-BN with the apparatus 100 are described below with reference to FIG. 3.

Figure 2:
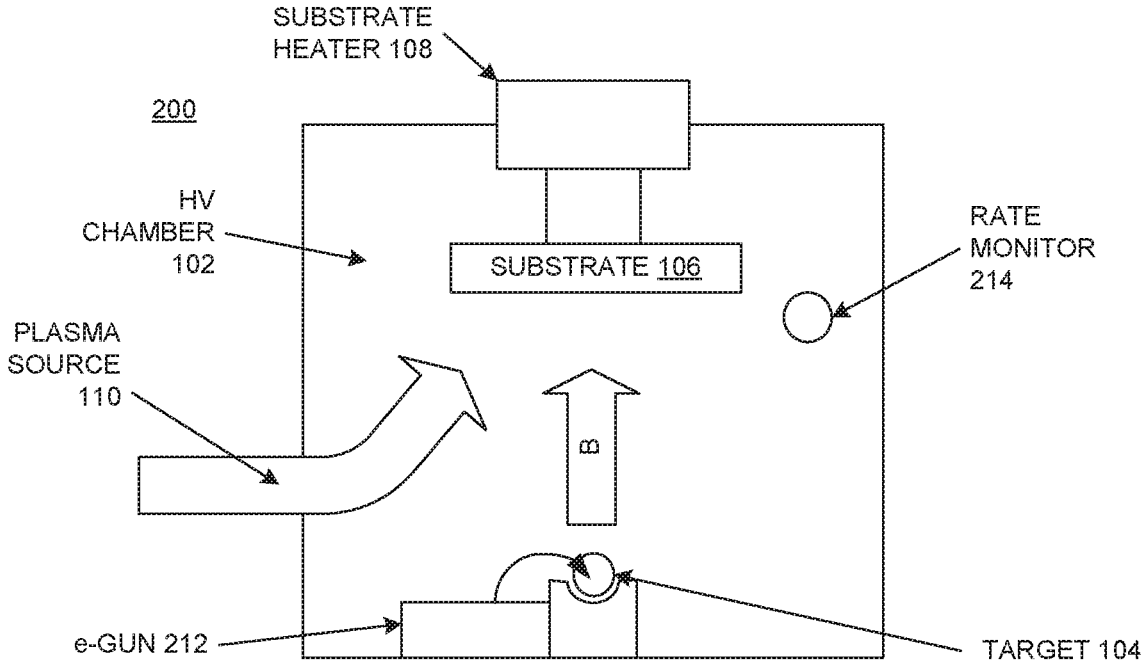
FIG. 2 illustrates a system or apparatus for performing a method of synthesizing h-BN in embodiments according to the present invention.

FIG. 2 illustrates a system or apparatus 200 for performing a method of synthesizing h-BN in some embodiments according to the present invention. The apparatus 200 includes the HV chamber 102, a source or target 204 inside the HV chamber, the substrate 106, and the substrate heater 108, and can also include the nitrogen plasma source 110. The source 204 includes boron in, for example, a crucible. In embodiments, the boron in the source 204 is high-purity (e.g., greater than 99 percent) or ultra-high purity (e.g., greater than 99.9 percent or even greater than 99.999 percent).

The apparatus 200 also includes a device 212 such as an electron beam (e-beam) gun that can evaporate the boron in the source 204. Methods of synthesizing h-BN with the apparatus 200 are described below with reference to FIG. 3. In an embodiment, the apparatus 200 includes a rate monitor 214 (e.g., a quartz crystal microbalance) that can be used to measure the rate at which evaporated boron is deposited on the substrate 106 during synthesis. In an embodiment, the apparatus 200 includes a shutter 216 between the source 204 and the substrate 106 that, when closed, can be used to prevent evaporated boron from the source from reaching the substrate.

The synthesis of h-BN using the apparatus 100 or the apparatus 200 is now described with reference also to FIG. 3, which is a flowchart 300 of methods for synthesizing h-BN in embodiments according to the invention.

In block 302, the HV chamber 102 is evacuated to a pressure of less than $10^{-3}$ Torr, specifically a pressure in the range of $10^{-6}$ to 10-10 Torr.

In block 304, particles of boron are generated from a boron source inside the HV chamber 102. In the FIG. 1 embodiments, the source is the source 104; in the FIG. 2 embodiments, the source is the source 204.

In the FIG. 1 embodiments, in block 304, the source 104 is bombarded with argon ions and sputtered towards the substrate 106. This can be achieved using magnetron (direct current, RF, or high-power impulse), pulsed, or ion beam sputter deposition techniques, for example. Sputtering techniques such as high-power impulse and ion-beam sputter deposition provide higher sputtering rates.

Sputtering has the advantage of wafer-scale growth of h-BN with good control and reproducibility of stoichiometry and material quality. Significantly, it does not require the use of solvents, toxic precursors, or reactive gases. It also offers flexibility in choosing the substrate material. In addition, it is not a self-limiting process as is often the case with chemical vapor deposition (CVD).

In the FIG. 1 embodiments, the substrate 106 is heated to high temperatures (greater than 700 degrees-Celsius (° C.), preferably above 900° C., but less than 1500° C.) to promote h-BN crystalline growth. To supply active nitrogen species during the growth process, a reactive sputtering technique can be implemented by mixing a prescribed ratio of nitrogen ($N_2$) and argon (Ar) process gases into the HV chamber 102.

As an alternative to the reactive sputtering technique, or in conjunction with it, the nitrogen plasma source 110 is directed towards the substrate 106 to provide and replenish active nitrogen species, compensating for BN decomposition from the sputtering process and high substrate temperatures. This reduces or eliminates decomposition sites that otherwise could limit the substrate temperature and lead to emission defects, which would lower the luminescence efficiency and cause emission from less desirable UV and visible bands. Also, sputtering is a deposition rather than a crystal growth technique, so the introduction of reactive nitrogen and the high substrate temperature enhance surface kinetics and bonding, similar to traditional epitaxy techniques. In addition, the high substrate temperature and plasma environment can help alleviate the incorporation of unwanted impurities that might otherwise result if less than ultra-high purity (e.g., less than 99.9-99.99%) is used in the source 104.

In the FIG. 2 embodiments, in block 304, elemental boron (e.g., 99.999% purity) in the source 204 (e.g., in a crucible) is evaporated toward the substrate 106 using the evaporating device (e.g., e-beam gun) 212. E-beam evaporation has the advantages of speed and atom-by-atom unit depositions. Significantly, it does not require the use of solvents, toxic precursors, or reactive gases. Also, the high-purity source material introduces almost no impurities into the HV chamber 102 after a careful outgassing cycle. Furthermore, relative to the embodiments of FIG. 1, there are no Ar ions to manage, and so there is a lower background pressure. Growth in a higher vacuum provides a longer mean free path, which helps reduce impurities and unwanted reactions from residual gases, leading to a more uniform and higher crystalline quality film.

The substrate is heated to high temperatures (greater than 700° C., preferably above 900° C., but less than 1500° C.) to promote h-BN crystalline growth rather than polycrystalline BN formation. The substrate temperature can be closely controlled using temperature (e.g., proportional-integral-derivative (PID)) controllers and possibly multi-zone heaters, and monitored using thermocouples and pyrometers, so that any non-uniformity in boron flux would lead to only small variations in film thickness, which is not a critical issue.

The nitrogen plasma source 110 can be directed towards the substrate 106 to supply the active species to form (grow) h-BN on the surface of the substrate. Alternatively, the growth can be performed in a nitrogen-rich regime (the boron flux is rate-limiting), in which case multiple plasma heads can be utilized, especially at high deposition rates. This also helps reduce non-uniformities across the substrate inside the chamber 102.

Figure 3:
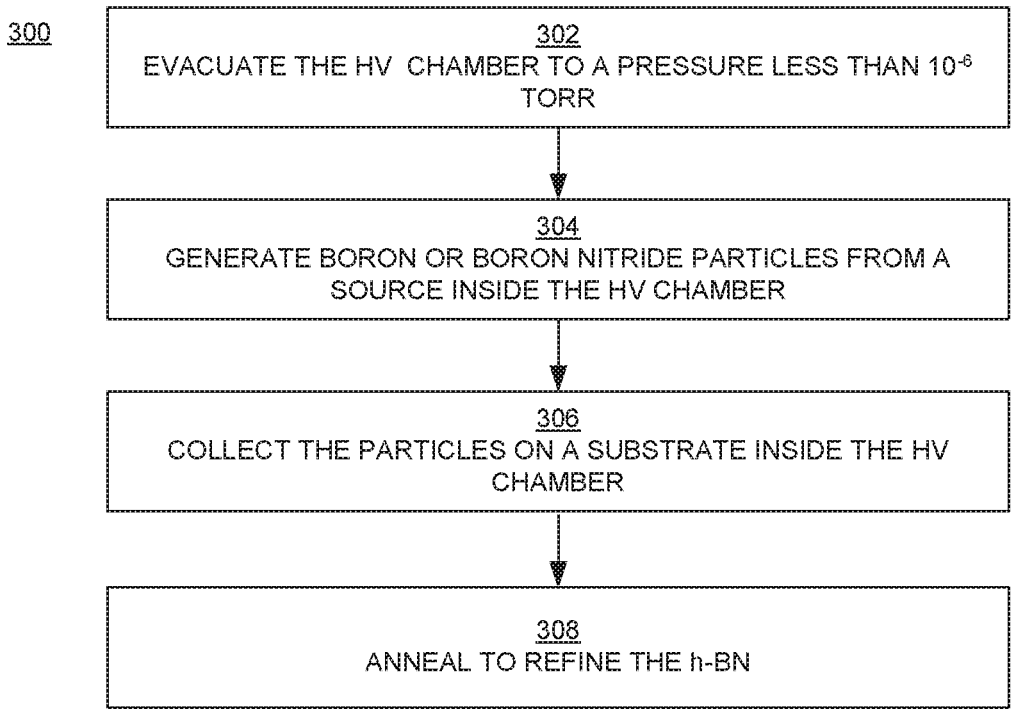
FIG. 3 is a flowchart of methods for synthesizing h-BN in embodiments according to the invention.

In block 306 of FIG. 3, the particles of boron or boron nitride are received at (e.g., are deposited on, are grown on) the substrate 106, thereby forming h-BN on the substrate.

In the FIG. 1 and FIG. 2 embodiments, the grown h-BN thickness is dependent on the deposition rate and process duration, ranging from several nanometers (nm) to several microns (μm).

In the FIG. 1 embodiments, the combination of high temperatures and plasma reactivity with sputtering can be significant. Growth rates on the order of one Angstrom per second (Å/s) can be readily achieved. Faster growth rates are possible by using a larger HV chamber or multiple sources. For example, a four-inch substrate growing at ten Å/s would yield a growth rate of about 60 milligrams per hour (mg/hr) of h-BN material, which could be even faster with larger substrate areas.

In the FIG. 2 embodiments, the deposition rate is monitored using the rate monitor 214. The deposition rate is limited to the range from 1 Å/s to ten Å/s. The shutter plate 216 can be used to allow the evaporated boron to reach the substrate 106 or prevent it from doing so, wholly or in part, and so can be used to control the deposition rate.

In the FIG. 1 and FIG. 2 embodiments, assuming a system operational cost of $50 per hour and a desired film thickness of five μm, growth at ten Å/s on a four-inch substrate would cost about $5.50 per square inch. Automatic loading and unloading of substrates results in high-throughput manufacturing of the h-BN.

In block 308 of FIG. 3, in the FIGS. 1 and 2 embodiments, in-situ annealing under a nitrogen plasma soak is optionally performed to further refine the h-BN.

In the FIG. 1 and FIG. 2 embodiments, the h-BN can either be used as-grown on the substrate 106, or be subsequently transferred onto any medium using, for example, a common polymethyl methacrylate (PMMA)-based technique. Alternatively, if the grown h-BN is to be harvested as a powder material, then given the weaker van der Waals bonding of h-BN layers, the grown material can be separated from the substrate 106 via mechanical or chemical exfoliation. Mechanical exfoliation involves a peel-off process, such as a ball milling process. Chemical exfoliation involves dispersing the h-BN material in an organic solvent (e.g., chloroform, dimethylformamide (DMF), etc.) with the assistance of sonication. In addition, if the substrate 106 is a substrate with a sacrificial layer, a laser lift-off process can then separate the h-BN from the substrate.

Figure 4:
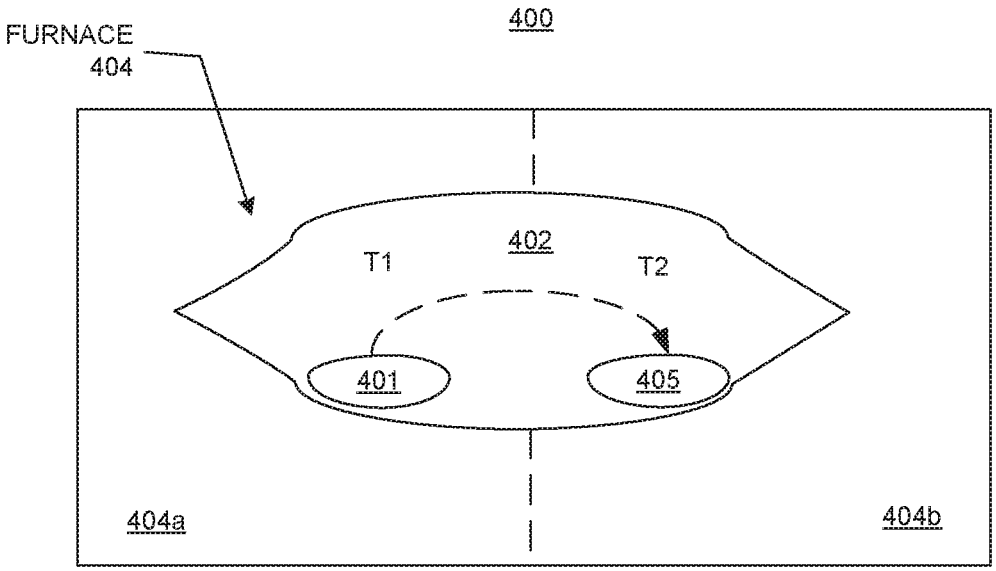
FIG. 4 illustrates a system or apparatus for performing a method of synthesizing h-BN in embodiments according to the present invention.

FIG. 4 illustrates a system or apparatus 400 for performing a method of synthesizing h-BN in some embodiments according to the present invention. The apparatus 400 includes a chamber or furnace 404 that includes a first zone 404*a* and a second zone 404*b*. The furnace 404 is configured so that the zones 404*a* and 404*b* can be heated two different temperatures T1 and T2, where T1 is greater than T2. This can be achieved using two separately controlled heaters, one for each zone, for example. An ampoule or container 402 that contains the h-BN is placed in the chamber 404 so that it straddles the two zones, such that one portion of the container 402 is in the first zone 404*a* and the remainder of the container is in the second zone 404*b*.

In an embodiment, the container 402 is a quartz tube. In embodiments, the container 402 is evacuated to a pressure less than $10^{-3}$ Torr, specifically to a pressure in the range of $10^{-6}$ to $10^{-10}$ Torr. In other embodiments, the container 402 is back-purged with nitrogen gas.

High-quality h-BN, produced using the apparatus 100 or 200 of FIG. 1 or FIG. 2, for example, is loaded into the container 402, specifically in the portion of the container that will be located in the first zone 404*a* of the chamber 404.

Figure 5:
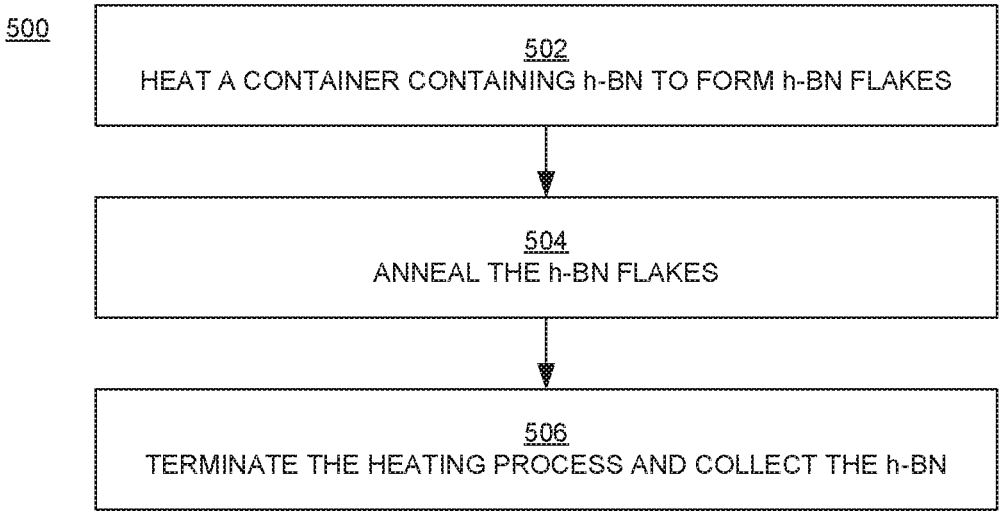
FIG. 5 is a flowchart of a method for synthesizing h-BN in embodiments according to the invention.

FIG. 5 is a flowchart 500 of a method for synthesizing h-BN using the apparatus 400 of FIG. 4 in embodiments according to the invention. The method of FIG. 5 can be used to produce h-BN or to refine the h-BN produced using the apparatus 100 or 200 of FIG. 1 or FIG. 2, for example.

An h-BN sample 401 is loaded into the container 402, specifically into the portion of the container that will be located in the first zone 404*a* of the chamber 404. In block 502 of FIG. 5, the container 402 is disposed within the chamber 404 and is heated. Specifically, the first zone 404*a* is heated to a higher temperature T1, around the BN decomposition temperature (about 1400-1600° C.), and the second zone 404*b* is heated to a lower temperature T2 (less than that of the first zone) to promote recrystallization of h-BN in the second zone, forming h-BN flakes 405. The heating process can last from one to 24 hours. In an embodiment, the temperatures are measured and monitored using a thermocouple and temperature controller (neither are shown) for each of the zones 404*a* and 404*b*.

In block 504, in an embodiment, the container 402 is heated to a relatively high temperature (e.g., greater than 900° C.), but lower than, or not much higher than, the BN decomposition temperature (about 1400° C.), in order to anneal the h-BN flakes 405 by promoting some reconstruction. Other than the process duration, the ramp rates can be adjusted for either a slow annealing or rapid thermal annealing.

In block 506, the heating process is terminated, and the resulting h-BN flakes 405 can be collected from inside the container 402 after they have cooled sufficiently (e.g., after they return to room temperature).

Multiple cycles of the process just described can be performed to further refine the h-BN that is produced by the process.

The method of FIG. 5 can be used to refine commercial h-BN powder into high optical quality h-BN. The resulting h-BN can subsequently be processed as needed and transferred onto any medium. Advantageously, this method does not require the use of toxic precursors, solvents, or reactive gases.

Figure 6:
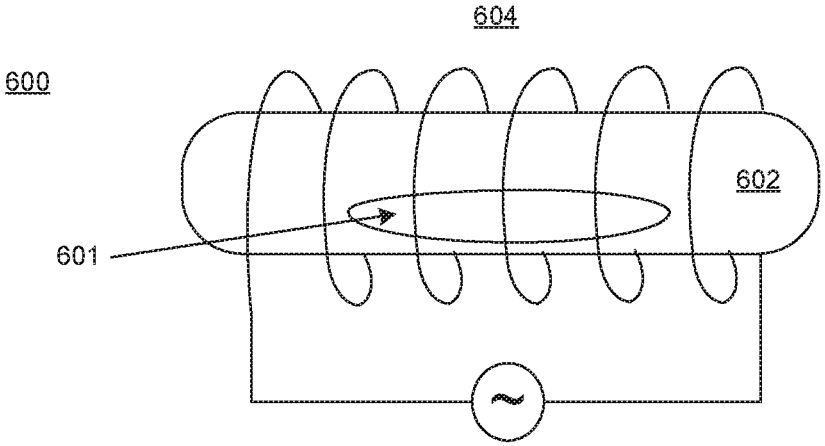
FIG. 6 illustrates a system or apparatus for performing a method of synthesizing h-BN in some embodiments according to the present invention.

FIG. 6 illustrates a system or apparatus 600 for performing a method of synthesizing h-BN in some embodiments according to the present invention. In embodiments, the apparatus 600 includes a coil 604 (e.g., an RF coil) that encircles an ampoule or container 602.

Figure 7:
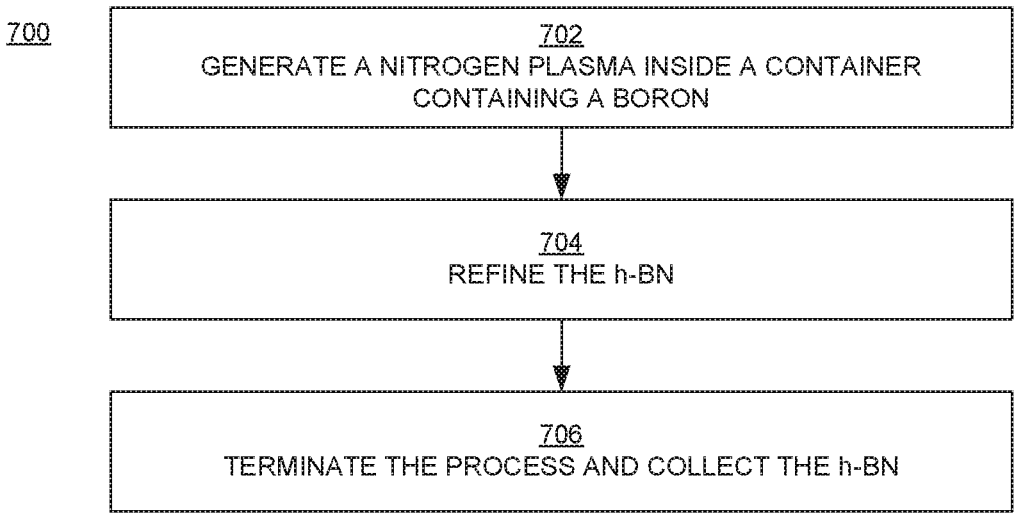
FIG. 7 is a flowchart of a method for synthesizing h-BN in embodiments according to the invention.

FIG. 7 is a flowchart 700 of a method for synthesizing h-BN using the apparatus 600 of FIG. 6 in embodiments according to the invention. This method can be used to grow bulk crystals of h-BN with high optical quality.

A sample 601 of elemental boron (e.g., greater than 99.999 percent purity) that is finely ground (to about one μm or smaller) and ultra-high-purity $N_2$ gas (e.g., 99.9999 percent purity) are loaded into the container 602. In an embodiment, an h-BN seed crystal can be introduced into the container 602 to promote nucleation sites for the h-BN crystals to grow.

In block 702 of FIG. 7, a nitrogen plasma is generated inside the container 602 using the coil 604. The active species from the plasma can then react with the sample 601 of boron to form h-BN. The container 602 can either be heated to a specified temperature (e.g., an optimal growth temperature) or, the heat generated by the nitrogen plasma can be relied on to heat the container.

In block 704, in an embodiment, the process described above in conjunction with FIGS. 4 and 5 can be applied to further refine the resulting h-BN.

In block 706, the method is terminated, and the resulting h-BN can be collected from inside the container 602 after it has cooled sufficiently (e.g., after it returns to room temperature).

A benefit of the method just described is that it does not require the use of toxic precursors, solvents, or reactive gases.

Figure 8:
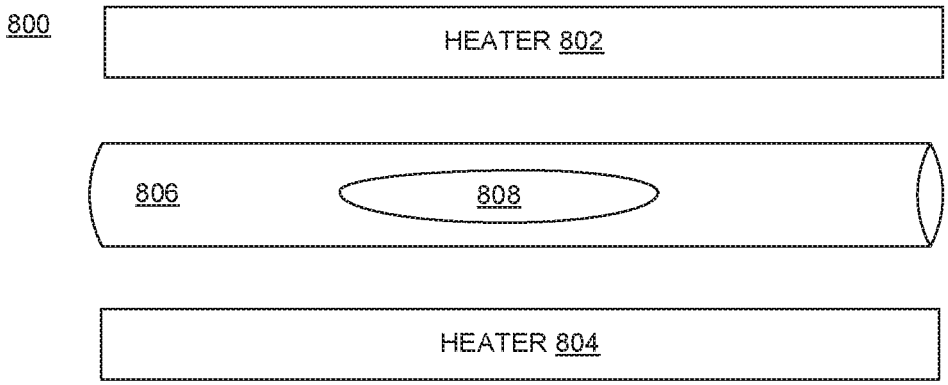
FIG. 8 illustrates a system or apparatus for performing a method of synthesizing h-BN in embodiments according to the present invention.

FIG. 8 illustrates a system or apparatus 800 for performing a method of synthesizing h-BN in some embodiments according to the present invention. The apparatus 800 includes a furnace that includes a first heater 802 and a second heater 804. A container 806 (e.g., a quartz tube) is located between the heaters 802 and 804. A sample 808 of h-BN is loaded inside the container 806. The sample 808 may be h-BN powder or it may be h-BN that is fabricated as described above in conjunction with FIGS. 1-7.

Nitrogen gas or an inert gas like argon can be flowed through the container 806 to minimize the presence of undesired contaminants and protect the h-BN in the sample 808. Alternatively, this can be done under low vacuum or even high vacuum.

Figure 9:
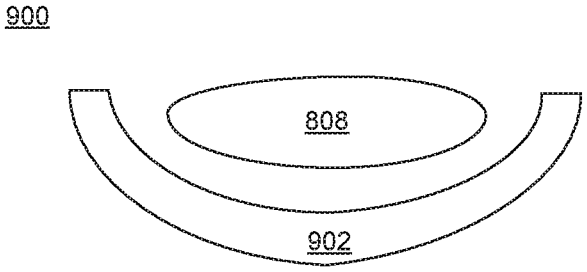
FIG. 9 illustrates an example in which a sample of h-BN is placed inside apparatus for performing a method of synthesizing h-BN in embodiments according to the present invention.

FIG. 9 illustrates an example in which the sample 808 of h-BN is placed inside a structure 900 that is loaded into the apparatus 800, in an embodiment according to the present invention. In embodiments, the structure 900 includes a quartz boat 902 that holds the sample 808 of h-BN powder.

Figure 10:
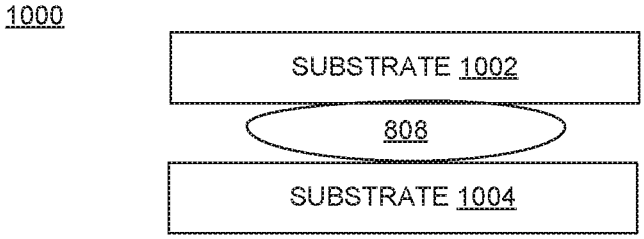
FIG. 10 illustrates an example in which a sample of h-BN is placed inside apparatus for performing a method of synthesizing h-BN in embodiments according to the present invention.

FIG. 10 illustrates an example in which the sample 808 of h-BN is loaded into a structure 1000 that is placed in the apparatus 800, in an embodiment according to the present invention. In embodiments, the structure 1000 includes a layer of h-BN sandwiched between wafers or substrates 1002 and 1004 that are tolerant to high temperatures. The substrate 106 of FIGS. 1 and 2 can be used as the bottom substrate 1004, for example.

Figure 11:
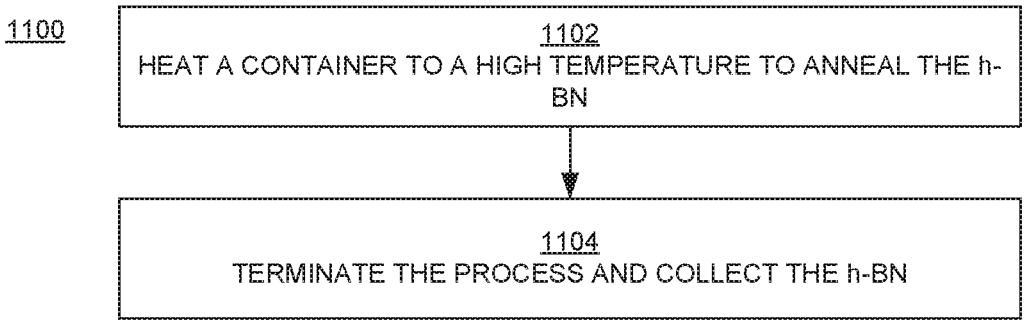
FIG. 11 is a flowchart of a method for synthesizing h-BN in embodiments according to the invention.

FIG. 11 is a flowchart 1100 of a method for synthesizing h-BN using the apparatus 800 of FIG. 8 in embodiments according to the invention.

In block 1102 of FIG. 11, the apparatus 800 (including the sample 808, e.g., the structure 900 or 1000) is heated to a high temperature (e.g., greater than 900° C.) that is about or not much higher than the BN decomposition temperature (about 1500° C.), to promote annealing but prevent a loss of h-BN. The temperatures can be measured and monitored using a thermocouple and temperature controller (not shown). The ramp rates can be adjusted for either slow annealing or rapid thermal annealing. Multiple cycles of the process can be performed to further refine the h-BN. The annealing process can last from an hour to a day, for example.

This annealing process, performed on previously fabricated h-BN, can further refine the h-BN quality and therefore its optical properties. The face-to-face annealing process performed using the structure 1000 can promote diffusion onto the substrates 1002 and 1004 and/or prevent h-BN decomposition at high temperatures (e.g., greater than 1400° C.).

In block 1104, the resulting h-BN can be collected after it cools sufficiently (e.g., after it returns to room temperature).

The process parameters and sequence of steps described illustrated herein are given by way of example only and can be varied as desired. For example, while the steps described herein may be shown or discussed in a particular order, these steps do not necessarily need to be performed in the order illustrated or discussed. The various example methods described herein may also omit one or more of the steps described herein or include additional steps in addition to those disclosed.

The present invention, as disclosed in the embodiments of FIG. 1-11, provides high-throughput, low cost, high quality, and high purity processes for the synthesis of light-emitting-grade h-BN. The h-BN can be produced without the use of solvents and can be produced at very low (e.g., vacuum or near vacuum) pressures. The h-BN produced as disclosed herein has an emission spectrum in which the luminescence peak at 215 nm is greater than the luminescence peak at 250 nm by a ratio R of five-to-one, ten-to-one, and even 100-to-one.

Figure 12:
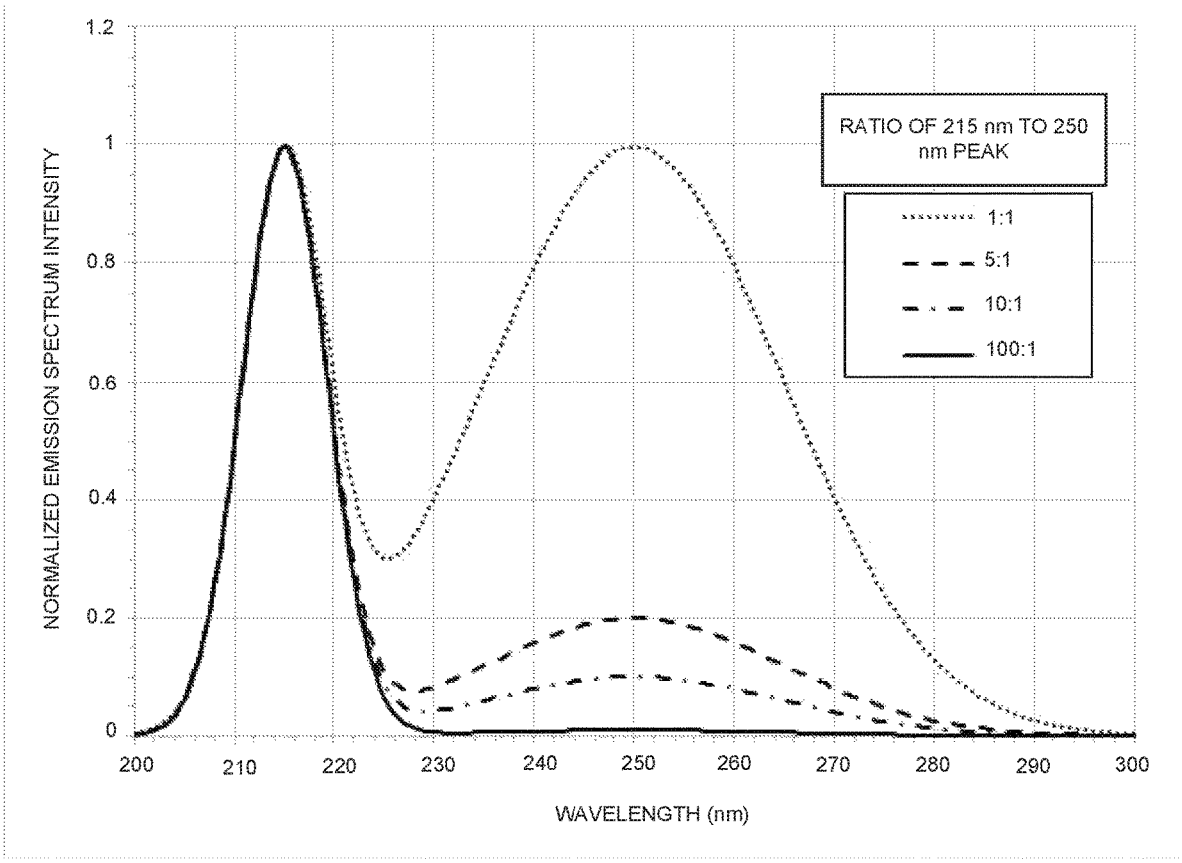
FIG. 12 illustrates emission spectra (normalized emission spectrum intensity) versus wavelength in embodiments according to the present invention.

FIG. 12 illustrates emission spectra (normalized emission spectrum intensity) versus wavelength showing selected ratios of the luminescence peak at 215 nm to the luminescence peak at 250 nm, in embodiments according to the present invention. The h-BN produced as disclosed herein has an emission spectrum in which the luminescence peak at 215 nm is greater than the luminescence peak at 250 nm by a ratio of five-to-one, ten-to-one, and even 100-to-one.

The h-BN produced as disclosed herein can be used in FELs including ultraviolet (UV) FELs that operate in a wavelength range of 200-230 nm, which can be deployed around people and used for inactivating or killing bacteria and viruses including SARS-CoV-2. In an embodiment, the light emitted by the UV-FELs is limited to the wavelength range of 200-230 nm. In another embodiment, the light emitted by the UV-FELs is substantially in the wavelength range of 200-230 nm. The term "substantially" is used here to mean that some of the emitted UV light may be outside that range, but not enough light is outside that range, or that light is not outside that range for a long enough period of time, to be unsafe for humans. Examples of such lamps are described below.

Semiconductor Materials of Group III and Group V Elements for UV Emission

The discussion to follow is primarily based on an example semiconductor material that includes aluminum gallium nitride (AlGaN). In general, the semiconductor material can include a combination of Group III elements and a Group V element. Group III elements include, for example, Al, Ga, and indium (In). Group V elements include, for example, nitrogen.

Gallium nitride (GaN) and aluminum nitride (AlN) are direct bandgap semiconductors that emit at approximately 365 nm and 210 nm, respectively. By forming a ternary AlGaN alloy, the emission wavelength can be tuned to any value in that range by adjusting the Al composition. Al-rich AlGaN, with Al compositions varying from approximately 50-90 percent, is used for light emitting diodes (LEDs) operating in the UV-B (280-315 nm) and UV-C (100-280 nm) bands. Also disclosed herein is the use of AlGaN materials as the light emitter in cathodoluminescence (CL)-based devices.

Figure 13:
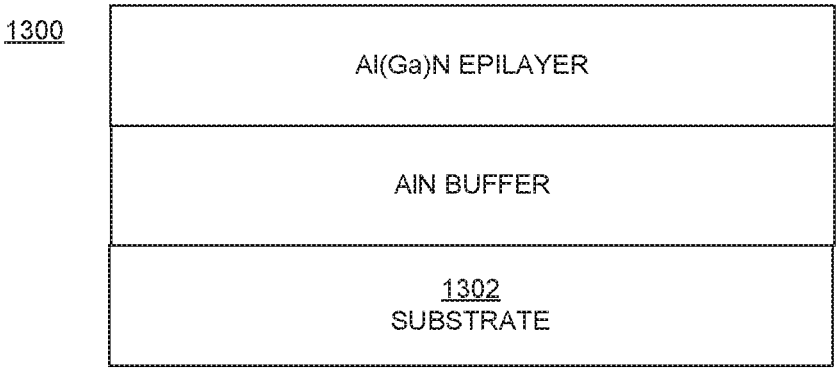
FIG. 13 illustrates an epitaxial aluminum nitride or aluminum gallium nitride (Al(Ga)N) wafer in embodiments according to the present invention.

FIG. 13 illustrates an epitaxial Al(Ga)N wafer 1300 in embodiments according to the present invention. The AlGaN wafer 1300 is grown on a substrate 1302 that is UV transparent and so can be directly used as the window material for CL-based lamps (FELs). The substrate 1302 can be either highly transmissive in the spectral region of interest (ideally 200-230 nm), or highly reflective in that spectral region of interest (either by native properties or by the deposition of a reflective layer prior to emitter growth). In an embodiment, the substrate 1302 is a sapphire substrate.

For an efficient CL-based lamp, the film thickness is preferably several microns thick given the penetration depth of the excitation electron beam. A growth rate between 300 nm to one μm per hour is typically achieved by molecular beam epitaxy (MBE). Faster growth rates (e.g., several μm/hr) can be achieved by metal organic chemical vapor deposition (MOCVD). Hydride vapor phase epitaxy (HVPE) of AlGaN with much faster growth rates has also been demonstrated. The wafer 1300 can be used as-is as a UV-emissive coated glass for optical or electron pumped emitter systems. The film can also be separated from the host substrate to be used as a free-standing layer or transferred onto a foreign substrate.

Figure 14:
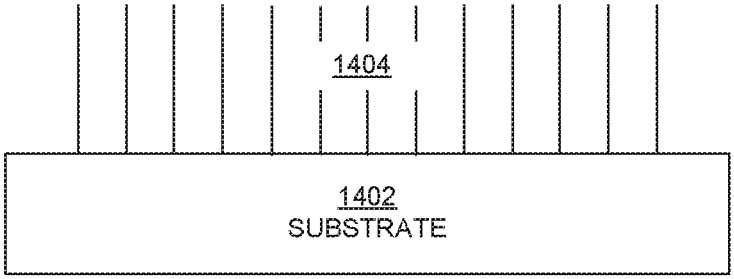
FIG. 14 illustrates free-standing Al(Ga)N nanowires grown on an ultraviolet (UV)-transparent substrate in embodiments according to the present invention.
Figure 15:
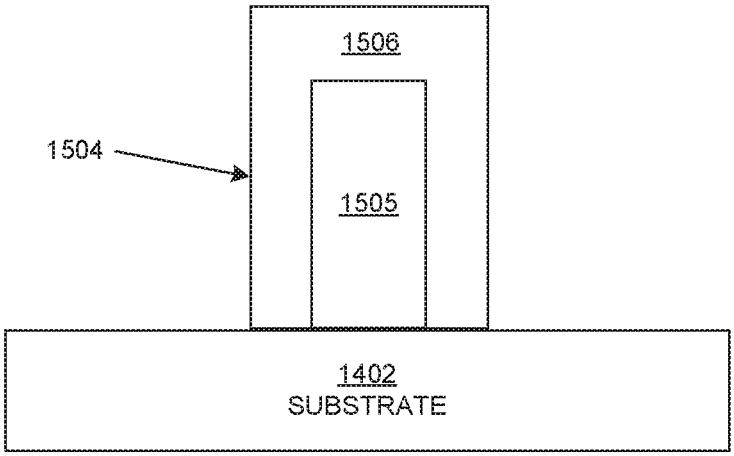
FIG. 15 illustrates a cross-section of a nanowire in embodiments according to the invention.

FIG. 14 illustrates free-standing AlGaN nanowires 1404 grown on a host substrate 1402 in embodiments according to the present invention. A key difference here, versus the FIG. 13 embodiments, is that the choice of substrate is less stringent. FIG. 15 illustrates a cross-section of a nanowire 1504 (one of the nanowires 1404), in embodiments according to the invention. In an embodiment, the nanowire 1504 includes a core region 1505 surrounded by a shell 1506. The composition of the core region 1505 is $Al_xGa_{1-x}N$, and the composition of the shell 1506 is $Al_yGa_{1-y}N$, where the value of x is less than the value of y.

Figure 16:
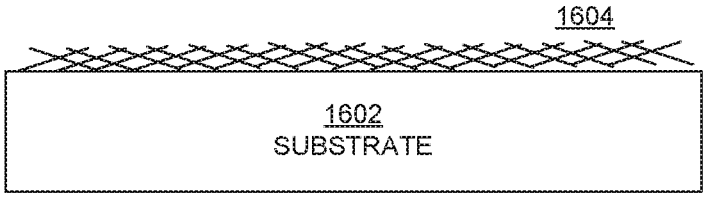
FIG. 16 illustrates dispersed nanowires 1604 on a UV-transparent substrate in embodiments according to the present invention.
Figure 17:
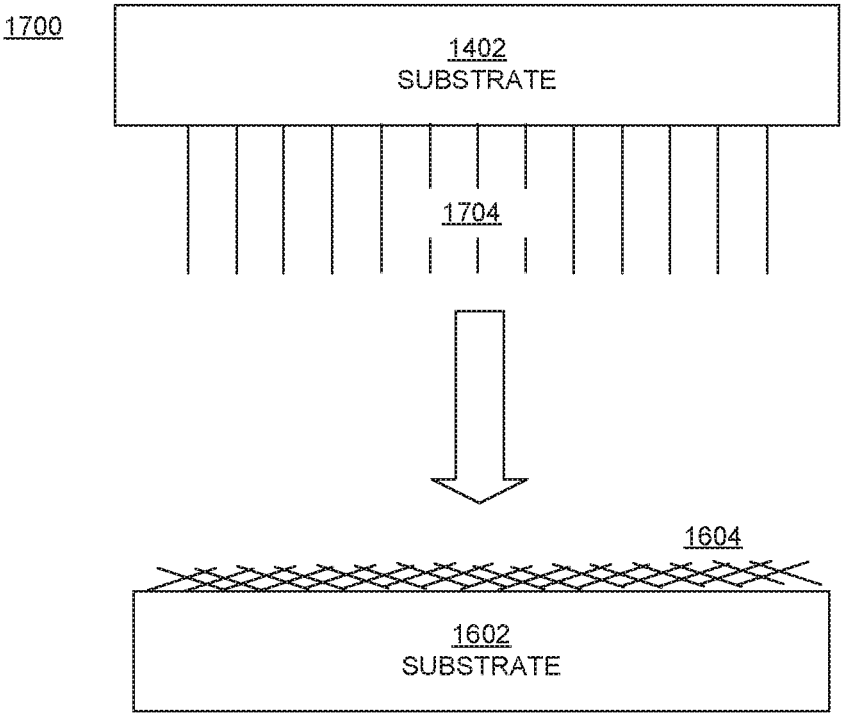
FIG. 17 illustrates a method of forming dispersed nanowires in embodiments according to the present invention.

FIG. 16 illustrates dispersed AlGaN nanowires 1604 on a UV-transparent substrate 1602 in embodiments according to the present invention. FIG. 17 illustrates a process of forming the dispersed AlGaN nanowires 1604 on the substrate 1602 in embodiments according to the present invention. A sample 1700 includes nanowires 1704 that are formed in the host substrate 1402. The nanowires 1704 are subsequently dispersed on the substrate 1602 using, for example, a mechanical or solution-based technique or a combination of both. While the nanowires 1704 are bonded to the host substrate 1402, their form factor makes it easy to break them from their stems. A mechanical technique may include a scratching (back-and-forth) motion can be used, in which one or both of the substrates 1402 and 1602 are moved back-and-forth relative to each other with the nanowires 1704 in contact with the substrate 1602. The individual nanowires themselves are very robust and will not be damaged, but a nanowire (either in its entirety or at least a portion of it) will break or separate from the host substrate 1402 and disperse onto the substrate 1602. A solution-based technique is to sonicate the sample 1700 in ethanol or isopropanol, to separate portions of or entire nanowires from the substrate 1402. Alternatively, if the nanowires 1704 are grown on a sacrificial layer (not shown) on the substrate 1402, such as $SiO_2$ on a silicon substrate, then the sacrificial layer can be chemically etched after growth (e.g., using hydrofluoric acid) to release the nanowires. The host substrate 1402 may be reused if desired after its surface is reconditioned. The dispersed nanowires 1604 can be transferred onto any medium and treated like a fine UV-light emitting powder for optical or e-beam pumped systems and in UV-FELs. Also, as described below, nanowires on a substrate can be used as or incorporated into a faceplate of an FEL.

UV-FELs and their Applications

Figure 18:
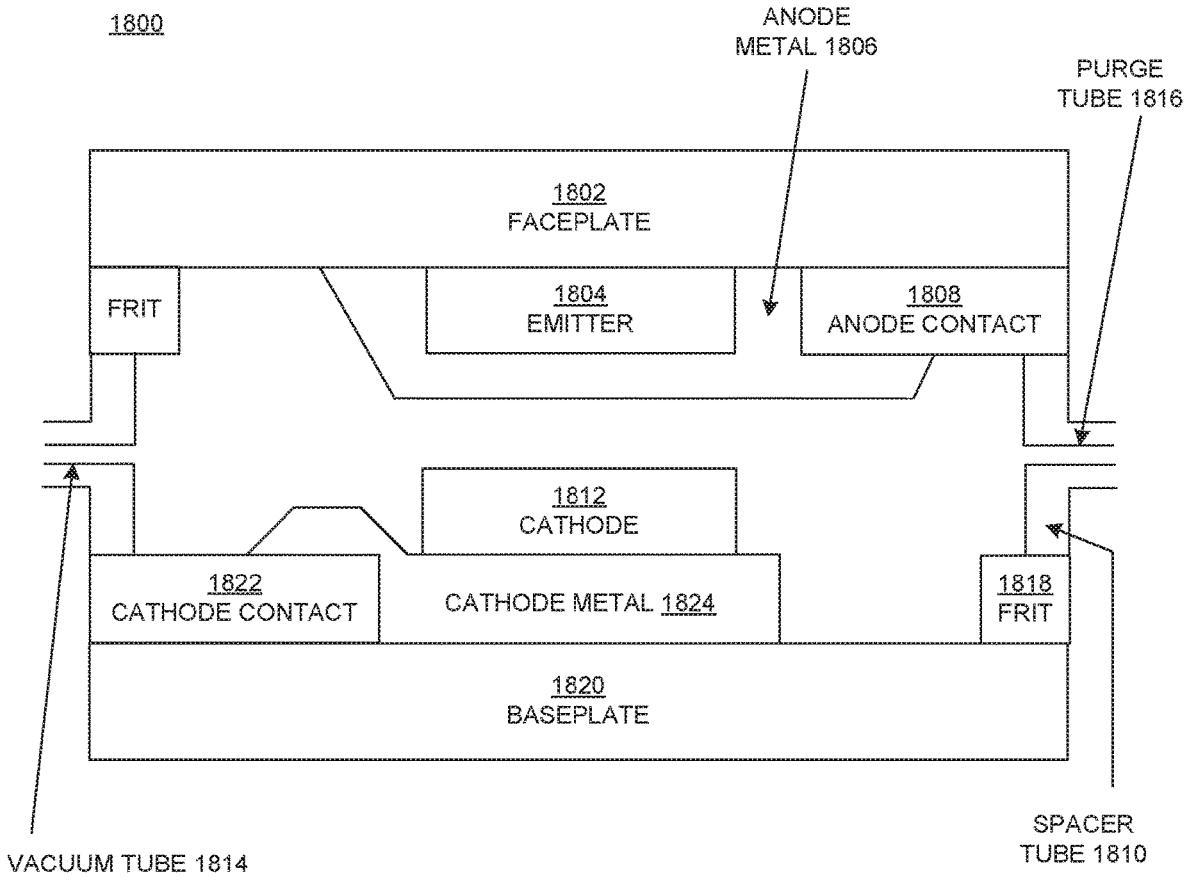
Fig. 18 (Conventional Art)
FIG. 18 illustrates a cross-section of an example of a conventional field-emission lamp (FEL).

FIG. 18 illustrates a cross-section of an example of a conventional FEL 1800. The FEL 1800 includes a faceplate 1802, which includes a transparent glass surface upon which an emitter 1804, anode metal 1806, and anode contact 1808 are coated. Light is emitted primarily through the transparent glass surface of the faceplate 1802.

The emitter 1804 is a CL material coated on the faceplate 1802 that is the source of light for the FEL 1800. The anode metal 1806 is a high conductivity and reflectivity layer that serves as an electrical contact to the emitter 1804 as well as a reflector to direct light emitted away from the faceplate 1802 back toward the faceplate and out of the FEL 1800. The anode contact 1808 is conductive frit material that serves to electrically connect the anode metal 1806 to the outside of the FEL 1800, where it can be contacted by a power supply (not shown).

A spacer tube 1810 is a hollow glass tube that serves to separate the cathode 1812 and the anode 1806, and provides locations for electrical contacts and for vacuum and purge tubes 1814 and 1816. The vacuum tube 1814 allows connection of a vacuum system to the FEL 1800, to enable evacuation of the lamp interior to high vacuum levels, as required for lamp operation. The purge tube 1816 allows the introduction of nitrogen to the FEL 1800 prior to the lamp being sealed.

The frits (e.g., the frit 1818) are insulating glass that serve as an adhesive to bond the faceplate 1802 and the baseplate 1820 together. The baseplate 1820 is a glass plate upon which the cathode contact 1822, cathode metal 1824, and cathode 1812 are located. The cathode 1812 is the source of electrons in the FEL 1800. The cathode metal 1824 is the electric contact to the cathode 1812. The cathode contact 1822 is a conductive glass frit that connects the cathode metal 1824 to the exterior of the FEL 1800 for connection to the power supply.

During operation, a high voltage (e.g., 1-20 kilovolts) is applied between the cathode 1812 and anode 1806, which causes electrons to be accelerated towards the anode and, after passing through the thin metal of the anode, to bombard the emitter 1804. The emitter 1804 is brought into an excited state by the electrons, and then emits light. The interior of the FEL 1800 is kept under sufficient vacuum to allow this to occur (e.g., a pressure less than $10^{-6}$ Torr).

During operation, the relatively low efficiency of the emitter 1804 will lead to a very high operating temperature for the FEL 1800. This heating effect occurs in the emitter 1804 and affects only the emitter side (the faceplate side) of the lamp.

Embodiments according to the present invention introduce a design that allows heat to be better extracted from a UV-FEL, and especially from the region of the emitter of a UV-FEL.

Figure 19A:
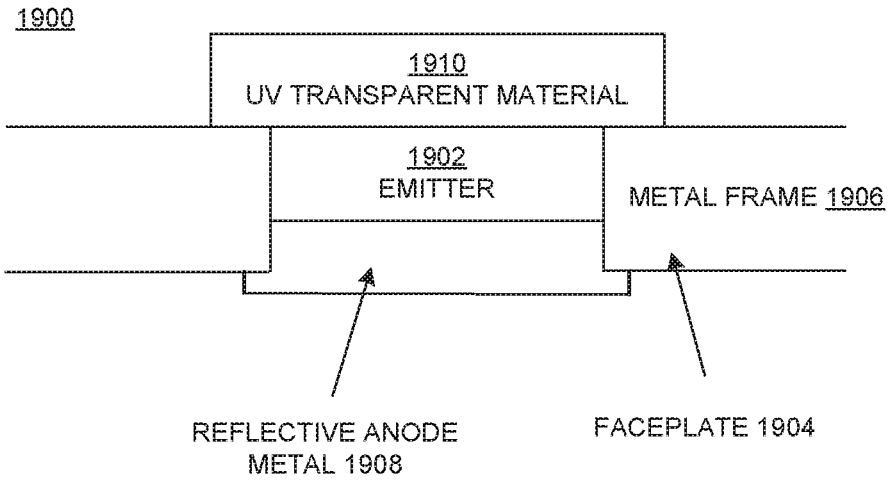
FIG. 19A illustrates a cross-section of a portion of a UV-FEL in embodiments according to the present invention.

FIG. 19A illustrates a cross-section of a portion of a UV-FEL 1900 in embodiments according to the present invention. In embodiments according to the present invention, the emitter 1902 (and other emitters described below) emit light in the UV range. In these embodiments, the UV emitters include materials such as GaN, AlN, AlGaN, indium aluminum gallium nitride (InAlGaN), InAlN, and h-BN.

In the FIG. 19A embodiments, a thermally conductive material near the emitter 1902 is used to extract heat from the region of the emitter. Specifically, in an embodiment, the faceplate 1904 includes a metal frame 1906. The emitter region is surrounded with the metal frame 1906, allowing better extraction of heat, especially if the metal directly contacts the emitter 1902.

There is a wide variety of materials that are suitable for heat extraction including (but not limited to) copper (Cu), gold (Au), silver (Ag), tungsten (W), aluminum (Al), aluminum nitride (AlN), and silicon carbide (SiC). The use of metal allows design alterations that improve thermal management and also eases manufacture.

In embodiments, the reflective metal of the anode 1908 can be deposited in such a way as to cover the emitter 1902 in the manner illustrated, and also contact the metal frame 1906 surrounding the emitter. In the FIG. 19A embodiments, UV-transparent material 1910 is placed over the emitter 1902 (on the exterior surface of the FEL 1900). The UV-transparent material 1910 may be composed of fused silica. The UV-transparent material 1910 can be patterned to lessen the losses due to wave-guiding. One way to do this is to roughen the side of the UV-transparent material 1910 facing out from the FEL 1900 (by grinding or etching, for instance), to provide a way for light to escape and avoid being reflected from its surface. This approach has the advantage that the light output from such a roughened surface will be diffused and will emit over a wide angular range. This has the advantage of providing uniform illumination from a smaller number of UV-FELs in an array.

Another approach is to introduce an organized perturbation of the outer surface of the UV-transparent material 1910 by introducing a pattern that can assist with light extraction, such as microlenses or prisms on the surface of the UV-transparent material.

In embodiments, the emitter 1902 may be grown via a semiconductor epitaxy process (e.g., MBE, MOCVD, etc.) onto a substrate that meets the requirements of the faceplate of an FEL. Such physical requirements include being strong enough to be used in the construction of the FEL (as it holds a vacuum). The substrate can be either highly transmissive in the spectral region of interest (ideally 200-230 nm), or highly reflective in that spectral region of interest (either by native properties or by the deposition of a reflective layer prior to emitter growth).

If the substrate is of the transmissive type (for example, sapphire), then it can be used in place of the UV-transparent material 1910 described above, either with the metal frame or as the entire faceplate. The substrate used as the faceplate (or parts of it) can be prepared as described herein to improve light extraction. Additionally, such a UV-transparent substrate, with a deposited emitter, can be bonded to the metal (or heat extracting) frame via an adhesive with good thermal conduction properties.

If the substrate is of the reflective type, then it can be used in concert with a heat-extracting frame, or, if its thermal transport properties are sufficient (e.g., similar to the examples given above) it can be used as the entire faceplate.

Figure 19B:
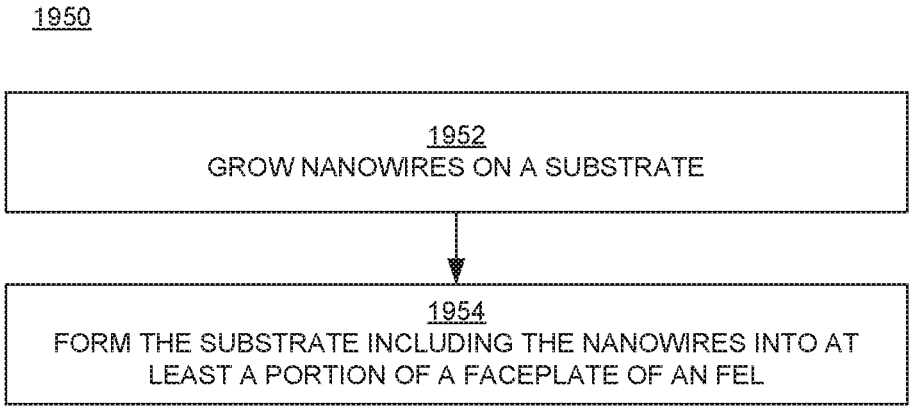
FIG. 19B illustrates a flowchart of an example of a method of manufacturing an FEL in embodiments according to the present invention.

FIG. 19B illustrates a flowchart 1950 of an example of a method of manufacturing an FEL in embodiments according to the present invention.

In block 1952, nanowires are grown on a substrate. The nanowires include a semiconductor material including at least a Group III element and a Group V element.

In block 1954, the substrate (including the nanowires is formed into at least a portion of a faceplate of the FEL.

Figure 20:
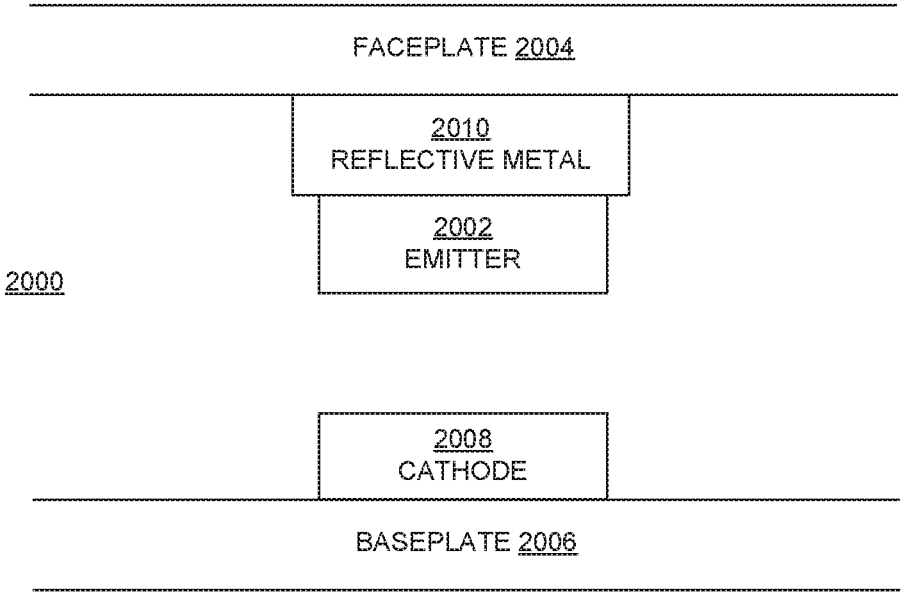
FIG. 20 illustrates a cross-section of a portion of a UV-FEL in embodiments according to the present invention.

FIG. 20 illustrates a cross-section of a portion of a UV-FEL 2000 in embodiments according to the present invention. In these embodiments, the emitter 2002 is placed directly on a thermally conductive material or substrate (e.g., the faceplate 2004) to extract heat from the emitter side (e.g., the faceplate side) of the UV-FEL 2000. Materials such as copper, gold, silver, tungsten, aluminum, aluminum nitride, and silicon carbide are suitable for the faceplate 2004 for that purpose. In this way, a substantial portion of the emitter 2002 can be in contact with the thermally conductive material, and heat can be much more efficiently dissipated. As a result, the operating temperature of UV-FELs disclosed herein remains below 100° C., and is less than 50° C. (e.g., less than 35° C.).

When metal is used for the faceplate 2004, the light produced by the emitter 2002 cannot pass through the faceplate and is reflected back towards the cathode 2008 and baseplate 2006. In embodiments, the reflective metal of the anode 2010 is deposited directly on the faceplate 2004, and the emitter 2002 is deposited atop the anode. Accordingly, the baseplate 2006 is made from UV-transparent material such as that described above, and may be roughened or patterned also as described above. Additionally, the cathode 2008 can be patterned in such a way as to allow light to escape in that direction from the UV-FEL 2000. Examples of patterned cathodes are presented in FIGS. 23 and 24 below.

When metal is used for the faceplate 2004, it can act as the anode of the UV-FEL, because both the reflective anode metal 2010 and the emitter 2002 will be in contact with it. This eliminates the need to deposit a conductive glass frit for the anode connection as in the example of FIG. 18. Eliminating that element and the associated manufacturing step lowers the cost to produce each UV-FEL and increases the manufacturing efficiency. In addition, it is more convenient to supply voltage directly to the faceplate 2004, and eliminates the need to attach a wire to the conductive glass frit used in the example of FIG. 18.

The use of metal in the faceplate 2004 provides a number of other advantages relative to the example of FIG. 18. In that example, the vacuum and purge tubes 1814 and 1816, which are used during the manufacturing process, are made of glass and are part of the spacer tube 1810. When the FEL 1800 is manufactured, these tubes need to be sealed while the interior of the FEL is kept at high vacuum. This is accomplished by using a flame to melt the tubes, causing them to close and seal the vacuum. This process leaves small glass tubes protruding from the body of the FEL, which makes the lamp difficult to handle and install. However, if a metal faceplate is employed, the tubes can instead be made to protrude out of the faceplate and, with the tubes attached in this way, the UV-FEL is easier to handle and install.

Moreover, if the faceplate and tubes are made of a softer metal, such as copper, then the tubes can be sealed mechanically by crimping the ends shut with sufficient pressure. This represents a significant advantage over the flame-sealing approach in terms of ease of process and worker safety.

Alternatively, if copper tubes, for example, are used for the purge and vacuum operations, they can be sealed during evacuation by brazing or cold welding (crimping). This has the advantage of not relying on the high flame temperatures required for glass melting.

In general, metal tubes are easier and cheaper to manufacture than a glass tube and are much less fragile.

Figure 21:
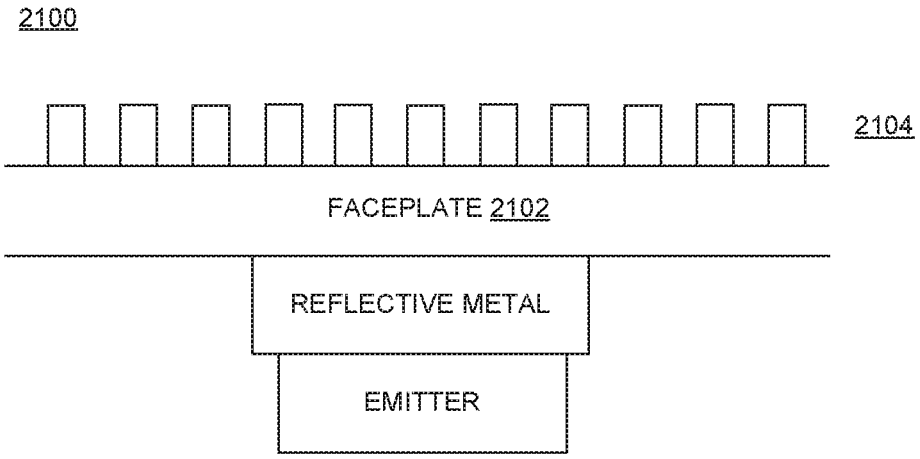
FIG. 21 illustrates a cross-section of a portion of a UV-FEL in embodiments according to the present invention.

FIG. 21 illustrates a cross-section of a portion of a UV-FEL 2100 in embodiments according to the present invention. In these embodiments, the effectiveness of the metal faceplate 2102 as a heat sink is improved by designing the outer face of the faceplate to have a high surface area for more efficient heat transfer. For example, the faceplate may include fins or pillars 2104.

Figure 22:
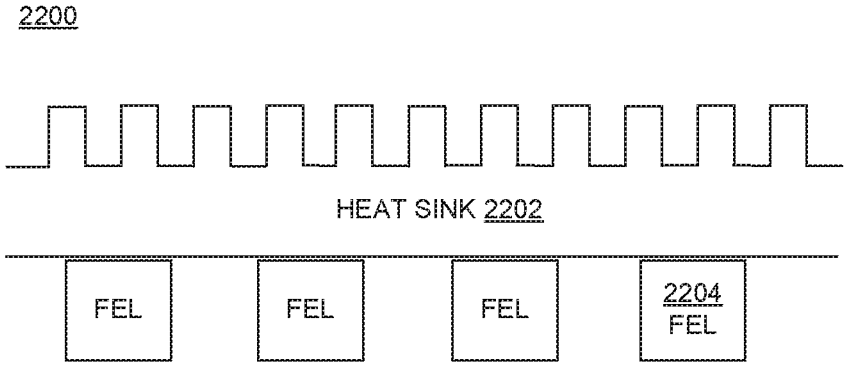
FIG. 22 illustrates a cross-section of a heat sink coupled to UV-FELs in embodiments according to the present invention.

FIG. 22 illustrates a cross-section of a heat sink 2202 coupled to UV-FELs 2204 in embodiments according to the present invention. In these embodiments, the relatively larger-size heat sink 2202 (exposed to the outside air) is connected to the individual FELs 2204. The thermal connection between the heat sink 2202 and the FELs 2204 may be completed by any number of materials, such as graphite sheets, thermal paste, or thermally conductive epoxy. The heat sink 2202 is useful in situations when the UV-FEL is installed in a location that does not provide a good path to cooler air for heat dissipation. The heat sink 2202 may be or may be coupled with a liquid (e.g., water) cooling system.

Cooling can also be provided or improved by a fan that may be mounted to the metal faceplate of a UV-FEL to provide additional airflow and thermal transfer.

Figure 23:
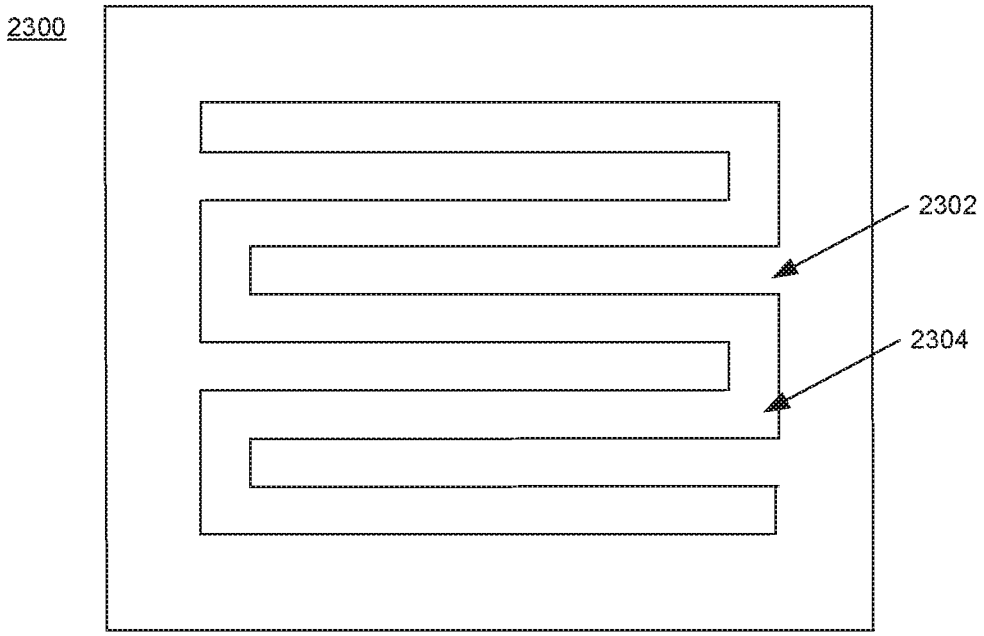
FIG. 23 illustrates an example of a cathode/cathode metal pattern in embodiments according to the present invention.

As mentioned above with reference to FIG. 20, in embodiments according to the invention, UV light is emitted through the baseplate 2006 when an opaque (e.g., metal) faceplate 2004 is used. In addition to making the baseplate out of a UV-transparent material, the cathode 2008 and associated cathode metal are patterned so that light may pass through them. FIG. 23 illustrates an example of a cathode/cathode metal pattern 2300 in embodiments according to the present invention. The pattern 2300 is referred to as an interdigitated pattern. Light can pass through the openings or gaps 2304 between the cathode metal 2302, while electron emission occurs from a region with the same extent as a solid cathode/cathode metal design. The lateral spreading of the emitted electrons as they move towards the anode ensures that electrons impinge on the whole emitter area, despite the patterning of the cathode and cathode metal.

Figure 24:
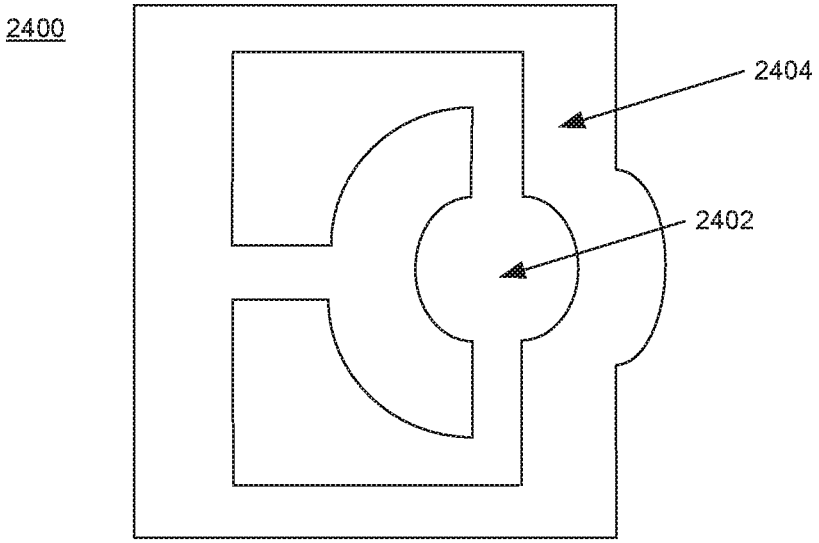
FIG. 24 illustrates another example of a cathode/cathode metal pattern in embodiments according to the present invention.

FIG. 24 illustrates another example of a cathode/cathode metal pattern 2400 in embodiments according to the present invention. The pattern 2400 is, in general, an annular pattern. The central region 2402 of the cathode metal 2404 of the cathode/cathode metal pattern 2400 is left open to allow unimpeded passage of light through that region. As in the example of FIG. 23, the lateral spread of electrons during their travel to the anode will ensure that electrons impinge on the entire emitter region.

During production and operation, UV-FELs according to the present invention are expected to experience a wide range of temperatures. As several different materials may be utilized in the UV-FELs, it is important that thermal stresses due to different coefficients of thermal expansion (CTE) are considered and mitigated properly.

To limit the stresses due to CTE mismatching, parts that may be affected can be joined by what is known as a toughened and flexibilized adhesive. Such an adhesive has a shear strength greater than 1000 psi (pounds per square inch), and an elastic modulus less than 50,000 psi. For UV-FELs, the adhesive used is also suitable for vacuum applications. An adhesive (or epoxy) with these characteristics lessen the stresses from CTE mismatch by deforming and absorbing some of the strain.

Another method for avoiding or mitigating the stresses due to CTE mismatch is to gradually reduce step-wise the CTE mismatch using a sequence of materials between two parts that have smaller individual CTE differences. As an example, connecting a copper part (CTE 17 parts per million (ppm)) to a borosilicate glass part (CTE 3.3 ppm) yields a CTE mismatch of 13.7 ppm, which would result in a large stress buildup during temperature cycling. If the copper is connected to a layer of nickel, which is in turn connected to a layer of iron, and then connected to a layer of tungsten, the largest difference in CTE between adjacent layers is 6.5 ppm, resulting in a much lower buildup of stress. Combining this method with the high shear/low modulus adhesive approach described just above can lessen the stress buildup even further.

Instead of or in addition to using a soft organic adhesive to join parts and thereby minimize CTE mismatch, a soft metal can be used. Indium is a very malleable metal that nevertheless is strong enough to be used to join materials. For example, indium is used in the semiconductor industry to create reliable, long term bonds between silicon (CTE 2.6 ppm) and copper (CTE 17 ppm) in applications that see considerable thermal cycling (e.g., a copper heat sink on a silicon chip).

In addition to the improvements already described herein, another improvement is to incorporate into UV-FELs a phosphor that emits in the visible spectrum (450-750 nm), so that there is an indication that the lamp is operating. When properly configured, the light emitted in the 200-230 nm range is completely invisible to the human eye, so it is useful to know if the UV-FEL is functioning correctly at a glance and without the need for a UV indicator card or power meter.

To summarize, improved UV-FELs as disclosed herein can be safely deployed close to people owing to the elimination of toxic materials, the mitigation of heating issues, and the emission of light confined to a wavelength range that is safe for human exposure. Following is a discussion and illustration of examples of apparatuses that incorporate those improvements and benefits, and can be employed to eliminate the causes of dangerous diseases, including severe acute respiratory syndrome coronavirus 2 (SARS-CoV-2), the coronavirus responsible for the Covid-19 pandemic.

In the examples below, the UV-FELs are shown as relatively small devices arranged in an array so as to produce uniform germicidal irradiation. The arrays of smaller UV-FELs can be replaced by larger or even smaller UV-FELs, depending on the scale of the application and associated requirements for uniformity of irradiation. For example, several smaller UV-FELs can be replaced by a single larger lamp that employs a diffuser that can spread the emitted light and so can achieve the required uniformity of irradiation with fewer lamps. The number of UV-FELs used in apparatuses such as those described below, and the arrangement of the UV-FELs, depend on factors such as the size of the lamps, the size of the application, the energy required, and the efficiency of the apparatus.

Figure 25:
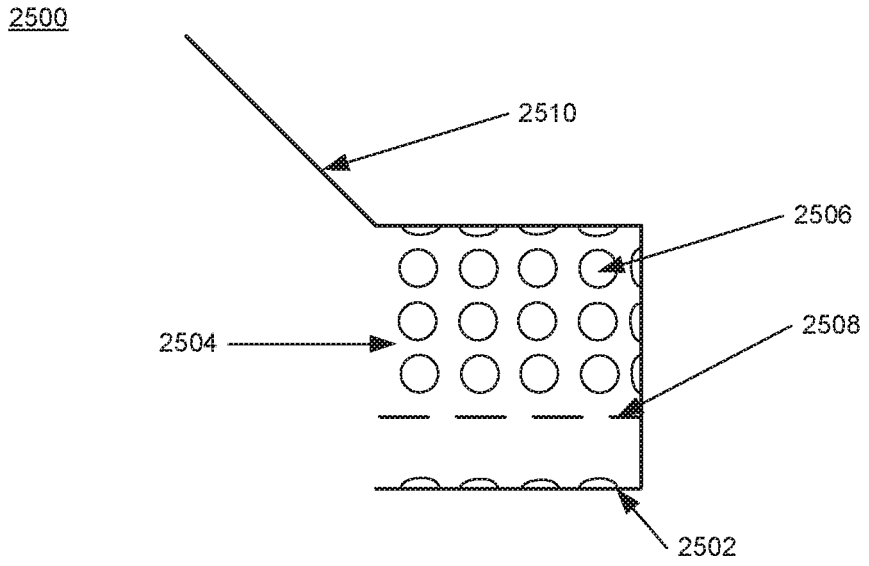
FIG. 25 is an example of an apparatus that includes UV-FELs in embodiments according to the present invention.

FIG. 25 is an example of an apparatus 2500 that includes UV-FELs in embodiments according to the present invention. The apparatus 2500 includes a container 2502. The container 2502 can be essentially box-like, only these embodiments are not so limited. In an embodiment, at least one side of the container 2502 is open; that is, the container incudes an opening. In one such embodiment, a door or cover 2510 or the like is moveably attached to each open side, so that the opening can be closed or can remain open.

The container 2502 can be used for the disinfection of objects. Accordingly, in embodiments, the container 2502 includes an array 2504 of UV-FELs (e.g., the UV-FEL 2506) on one, some, or all of its interior surfaces. The object to be disinfected can be placed inside the container 2502 through the aforementioned opening. If so desired, the door or cover 2510 can then be closed so that the object is completely enclosed inside the container 2502. In an embodiment, a platform 2508 or the like for supporting the object to be disinfected (e.g., a wire grid or UV-transparent slab of material) is used so that even the underside of the object is exposed to a lower array of UV-FELs, to insure proper disinfection of the entire object. The container 2502 can be powered from a suitably sized battery or using wired connection to a common electric outlet, for example.

The container 2502 provides a means by which an everyday object can be disinfected while minimizing the effect of shadowing on the process and also while providing a more thorough disinfection than would be achieved by the use of a standard UV lamp, which typically illuminates the item to be disinfected from one side only. Because all sides of the object can be disinfected at the same time using the container 2502, less time is needed to perform a complete disinfection.

The container 2502 can be manufactured in different sizes depending on the intended application, and can be applied to a variety of objects of any practical size. The size of the container 2502 can be small enough so that it is relatively lightweight and portable, and as such can be practically transported and used in different locations, such as by a person that is out shopping.

Figure 26:
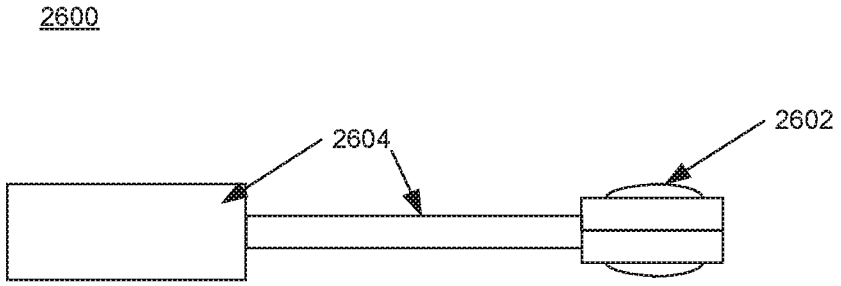
FIG. 26 is an example of an apparatus that includes one or more UV-FELs 2602 in embodiments according to the present invention.

FIG. 26 is an example of an apparatus 2600 that includes one or more UV-FELs 2602 in embodiments according to the present invention. The one or more UV-FELs are mounted onto an extendable (e.g., telescoping) handle 2604 or the like (e.g., an arm) or some other type of handling or actuating mechanism (e.g., a mechanical actuator such as a switch, pull, or slide), for portable disinfection of objects. The apparatus 2600 can be employed with, for example, one or two UV-FELs, allowing thorough disinfection of the interior of objects or harder to reach objects (e.g., objects under desks). The apparatus 2600 can be powered by, for example, a battery or a wired connection to a power source. A tripod (not shown) can be attached to hold the apparatus 2600 in place during the disinfection procedure.

In contrast to contemporary UV disinfection lights that are large, fragile, and cannot be safely inserted into objects, the apparatus 2600 can be safely inserted into an interior location without fear of breakage or other damage. The apparatus 2600 can be used, for example, in a janitorial setting to disinfect regions that would not be reached by overhead disinfecting systems, such as the underside of a desk or within a closet. A smaller version can be used to disinfect, for example, the interior of a purse or backpack.

Figure 27:
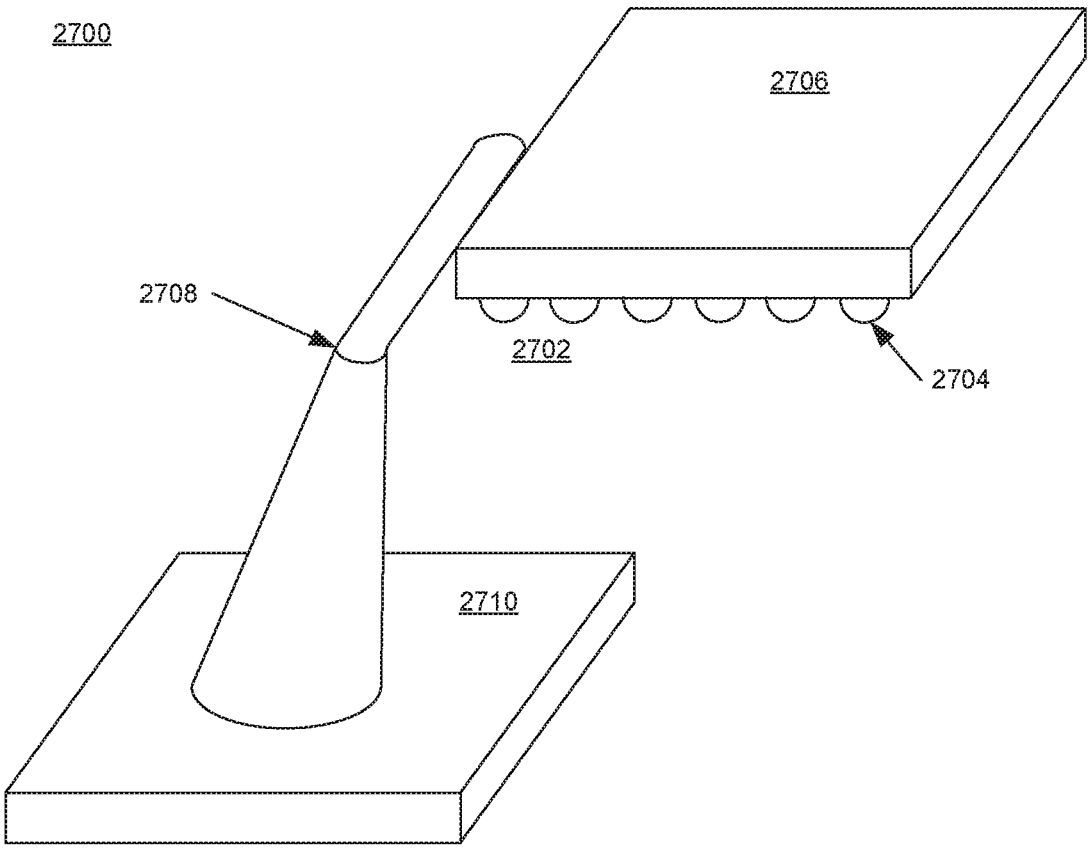
FIG. 27 is an example of an apparatus that includes an array of UV-FELs in embodiments according to the present invention.

FIG. 27 is an example of an apparatus 2700 that includes an array 2702 of UV-FELs (e.g., the UV-FEL 2704) in embodiments according to the present invention. The array 2702 of UV-FELs is mounted on a surface (e.g., the bottom surface) of a panel 2706 that is attached to a flexible or positionable handle 2708 or the like (e.g., an arm), or some other type of handling or actuating mechanism (e.g., a mechanical actuator such as a switch, pull, or slide), that may also be extendable (e.g., telescoping). The handle 2708 is in turn attached to a base 2710. The apparatus 2700 can be used for the direct disinfection of a work surface, for example. The handle 2708 allows the array 2702 to be aimed at the surface to be disinfected. The array 2702 of UV-FELs provides a uniform illumination of that surface. The apparatus 2700 can be powered by, for example, a battery or a wired connection to a power source.

The array 2702 of UV-FELs provides the equivalent of a large, extended light source. That is something that a competing technology cannot provide without using many conventional lights that are placed very close to each other, which produces significant thermal issues. Also, conventional lights are fragile and include toxic components. The extended light source of the apparatus 2700 allows for uniform illumination of a work area from a short distance, which means that the required disinfecting dose can be reached in a shorter period of time compared to a conventional light at the same distance. Also, the extended light source of the apparatus 2700 can reduce shadowing effects if the surface being disinfected is not perfectly smooth.

The apparatus 2700 can be used to disinfect food preparation surfaces or the surface of workspaces in factories, for example. The apparatus 2700 is portable, so it can be employed between work shifts or between classes in a school, for example.

Figure 28:
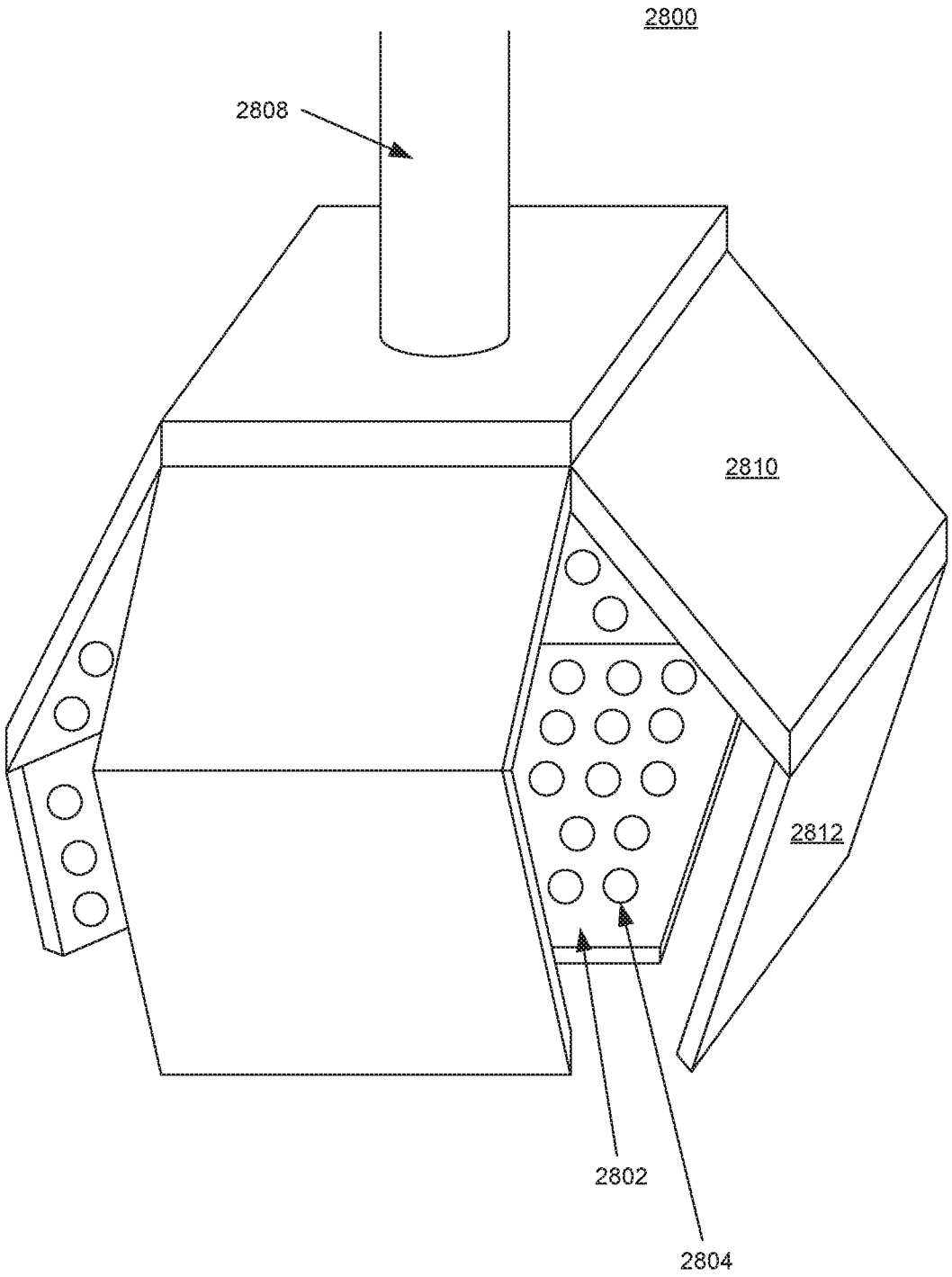
FIG. 28 is an example of an apparatus that includes multiple arrays of UV-FELs in embodiments according to the present invention.

FIG. 28 is an example of an apparatus 2800 that includes multiple arrays (e.g., the array 2802) of UV-FELs (e.g., the UV-FEL 2804) in embodiments according to the present invention. The apparatus 2800 includes a central panel 2806 attached to a flexible or positionable handle 2808 or the like (e.g., an arm), or some other type of handling or actuating mechanism (e.g., a mechanical actuator such as a switch, pull, or slide), that may also be extendable (e.g., telescoping). One, two, or more hinged panels (e.g., the panels 2810 and 2812) are moveably attached (e.g., with hinges) to each other and to each side of the central panel 2806. The hinged panels can each include a respective array of UV-FELs like the array 2802.

The adjustable design of the apparatus 2800 makes it suitable for the thorough disinfection of irregularly sized objects that are not easy or convenient to move such as, for example, a piece of factory equipment or a desk telephone.

The apparatus 2800 allows for the disinfection of all surfaces of the object in a much more thorough manner than illumination from a single UV lamp. Although the apparatus 2800 is shown with four sets of two side panels each, the central panel 2806 can have any practical number of sides with one or more panels attached to each side. The size of the apparatus 2800 can range from that of a desk lamp, for example, to a large wheeled device that can be transported (e.g., rolled) from location to location.

Also, the panels on the apparatus 2800 can be folded so that the arrays of UV-FELs point away from the apparatus, so they can be used to disinfect the interior of a large space.

Contemporary UV lamps cannot be used in the manner just described, because they get hot enough to pose a danger to close objects, which makes such lamps useless for thoroughly disinfecting a piece of equipment from all sides. The apparatus 2800 can be used to disinfect bedside medical equipment without interrupting their function or to disinfect gym equipment, for example.

Figure 29A:
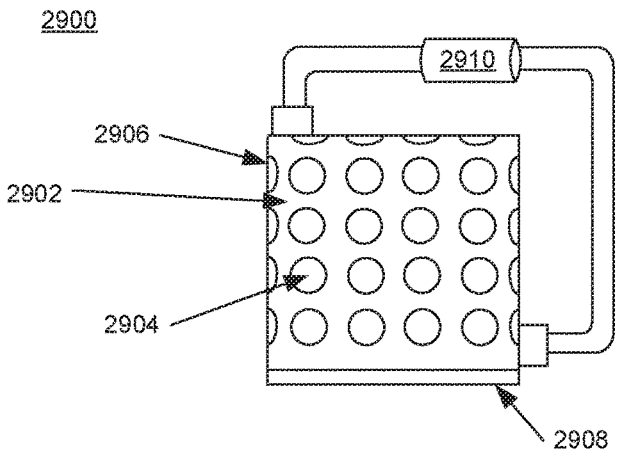
FIGS. 29A and 29B illustrate an example of an apparatus that includes multiple arrays of UV-FELs in embodiments according to the present invention.
Figure 29B:
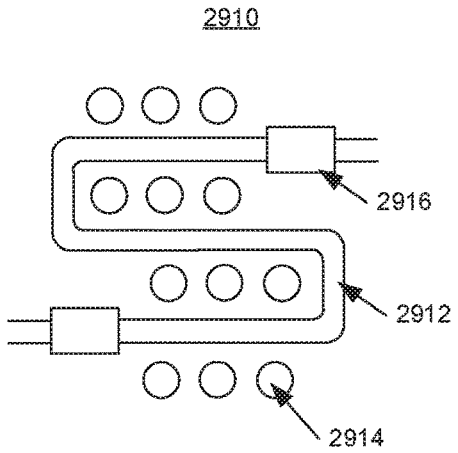

FIGS. 29A and 29B illustrate an example of an apparatus 2900 that includes multiple arrays (e.g., the array 2902) of UV-FELs (e.g., the UV-FEL 2904) in embodiments according to the present invention. The apparatus 2900 can be used to disinfect a workspace or room, for example.

The apparatus 2900 includes a container 2906 that is open (e.g., in the front) and has arrays (e.g., the array 2902) of UV-FELs on its interior surfaces except for the surface 2908 (e.g., the bottom surface). The surface 2908 is lined or covered with a material with high reflectance in the 200-230 nm range. The combination of UV-FELs on the interior surfaces and the reflective lower surface provide a disinfected environment on their own accord. However, in embodiments, the apparatus 2900 also includes an air disinfection system 2910 that recirculates air (e.g., using a blower 2916) from the container 2902 through a UV-transparent manifold 2912 (FIG. 29B) then back to the container. The manifold 2912 can include a number of folds or bends as illustrated in FIG. 29B, or it may include a more duct-like geometry. The sides of the manifold 2910 are lined with UV-FELs (e.g., the UV-FEL 2914). The recirculating air will pass very close to these UV-FELs, and the series of bends in the manifold increase the time that the air spends undergoing UV irradiation.

The apparatus 2900 can be implemented with or without the air disinfection system 2910, and with or without an upper surface, depending on the requirements of the workspace. The apparatus 2900 presents a relatively compact yet very effective method that disinfects not only work surfaces, but also disinfects the air in the work area. The apparatus 2900 can be used in a classroom environment, for food handling or preparation, and for medical equipment assembly and inspection, for example.

Figure 30A:
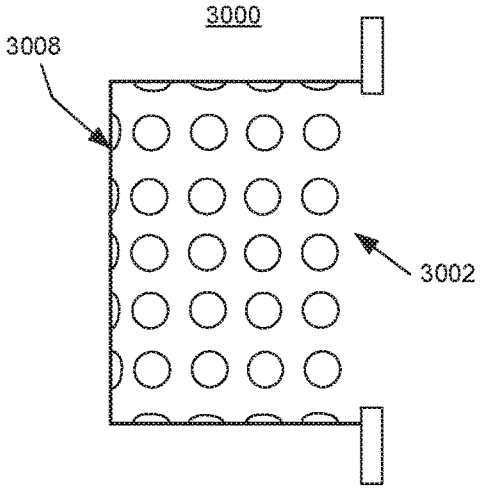
FIGS. 30A and 30B illustrate an example of an apparatus that includes multiple arrays of UV-FELs in embodiments according to the present invention.
Figure 30B:
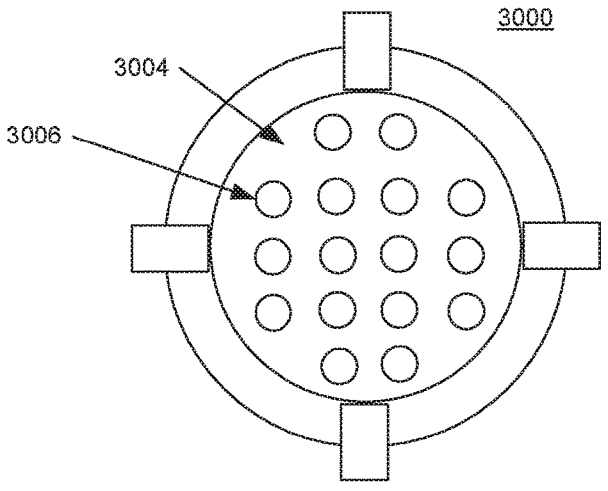

FIGS. 30A and 30B illustrate an example of an apparatus 3000 that includes (e.g., is lined with) multiple arrays (e.g., the arrays 3002 and 3004) of UV-FELs (e.g., the UV-FEL 3006) in embodiments according to the present invention. FIG. 30A is a cross-sectional view of the apparatus 3000, and FIG. 3B illustrates the inside of the apparatus including its rear surface. The apparatus 3000 can be attached to, and used to disinfect, a doorknob, light switch, or other like surfaces that are frequently touched.

The apparatus 3000 includes a container 3008 that is shaped and configured so that it can be attached to, encase, and uniformly disinfect a wide variety of designs. So that a user does not have to hold the apparatus 3000 in place, the apparatus includes some type of mechanism (e.g., magnets) allowing it to be attached to and readily detached from a doorknob or the like.

Conventional UV lamps cannot be safely held by a user and so cannot be easily used to disinfect objects like doorknobs, and in particular cannot be easily used to disinfect all sides/surfaces of objects like doorknobs.

Figure 31:
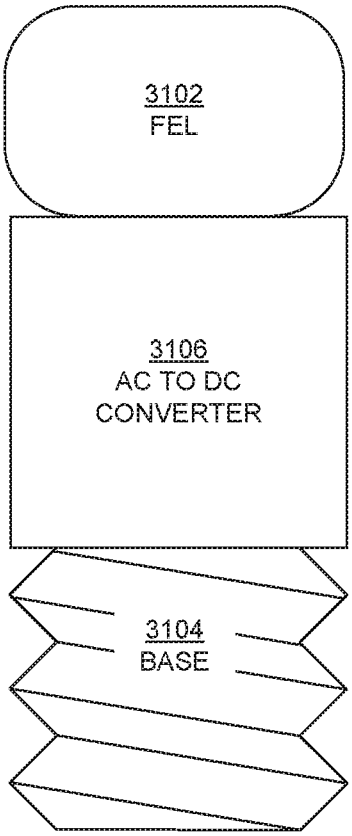
FIG. 31 is an example of an apparatus that includes a UV-FEL 3102 with or attached to a base that fits into a standard light socket, in embodiments according to the present invention.

FIG. 31 is an example of an apparatus 3100 that includes a UV-FEL 3102 with or attached to a base 3104 that fits into a standard light socket, in embodiments according to the present invention. The apparatus 3100 also includes a high voltage alternating current (AC) to direct current (DC) converter 3106 for the UV-FEL 3102 that can be incorporated into the base 3104. Accordingly, the UV-FEL 3102 can be directly substituted for a standard light bulb. The base 3104 makes the UV-FEL 3102 directly compatible with existing hardware and thus much easier to deploy, driving adoption more rapidly than would be the case if new hardware connections were needed.

The UV-FEL embodiments that are disclosed herein address the issues associated with conventional UV lamps. The disclosed UV-FELs do not contain hazardous materials such as chlorine gas and, due to the thermal management solutions described herein, remain cool enough so that they can be deployed and operated safely around people. Consequently, a broad range of new applications for UV-FELs, that are not feasible using conventional UV lamps, are now available. For example, UV-FELs disclosed herein can be deployed around people but can still be used for inactivating or killing bacteria and viruses (such as SARS-CoV-2) in the air and on surfaces in, for example, homes, offices, classrooms, and hospitals.

Although the subject matter has been described in language specific to structural features and/or methodological acts, it is to be understood that the subject matter defined in the present disclosure is not necessarily limited to the specific features or acts described above. Rather, the specific features and acts described above are disclosed as example forms of implementing the present disclosure.

Embodiments according to the invention are thus described. While the present disclosure has been described in particular embodiments, the invention should not be construed as limited by such embodiments, but rather construed according to the following claims.

What is claimed is:

1. A device, comprising:

a first plate comprising a heat-conducting material;

a second plate opposite the first plate and comprising a light-transmitting material;

an emitter comprising a source of ultraviolet (UV) light, between the first plate and the second plate;

a light-reflective material between the emitter and the first plate; and a cathode between the emitter and the second plate, wherein the cathode has an opening formed therein, and wherein, in operation, the UV light from the emitter passes through the opening and through the second plate.

2. The device of claim 1, wherein substantially all of the UV light has a wavelength in a range of 200-230 nanometers (nm).

3. The device of claim 1, wherein the light-transmitting material comprises fused silica.

4. The device of claim 1, wherein a surface of the light-transmitting material that is facing away from the emitter is roughened.

5. The device of claim 1, wherein a surface of the light-transmitting material that is facing away from the emitter is patterned with an array selected from the group consisting of: an array of prisms; and an array of microlenses.

6. The device of claim 1, wherein the heat-conducting material is metallic.

7. The device of claim 1, wherein a surface of the first plate that is facing away from the emitter comprises elements selected from the group consisting of: fins; and pillars.

8. The device of claim 1, coupled to a cooling element selected from the group consisting of: a heat sink; a fan; and a liquid cooling system.

9. The device of claim 1, wherein the first plate comprises an anode of the device.

10. The device of claim 1, wherein the light-reflective material comprises an anode of the device.

11. The device of claim 1, wherein the cathode comprises metallic interdigitated electrodes, wherein gaps in the interdigitated electrodes form the opening.

12. The device of claim 1, wherein the cathode comprises metallic elements that are disposed to form the opening.

13. The device of claim 1, further comprising a second source of light that emits light that is visible to the human eye when the device is operating.

14. The device of claim 1, wherein the emitter comprises hexagonal boron nitride.

15. The device of claim 1, wherein the emitter comprises materials selected from the group consisting of: gallium nitride; aluminum nitride; aluminum gallium nitride; indium aluminum nitride; and indium aluminum gallium nitride.

16. The device of claim 1, further comprising a base coupled to the cathode, wherein the base is configured for a standard light socket.

17. The device of claim 1, wherein tubes between the first plate and the second plate are sealed by a method selected from the group consisting of: brazing; and crimping.

18. The device of claim 1, with an operating temperature that remains below a temperature selected from the group consisting of: 100 degrees Celsius (° C.); 50° C.; and 35° C.

19. An apparatus, comprising:

a container; and a plurality of ultra-violet (UV) field-emission lamps (FELs) disposed on at least one surface of the interior of the container, wherein each UV-FEL in the plurality comprises:

a first plate comprising a heat-conducting material;

a second plate opposite the first plate and comprising a light-transmitting material;

an emitter comprising a source of UV light, between the first plate and the second plate;

a light-reflective material between the emitter and the first plate; and a cathode between the emitter and the second plate, wherein the cathode has openings formed therein, and wherein, in operation, the UV light from the emitter passes through the openings and through the second plate.

20. The apparatus of claim 19, wherein at least one side of the container is open.

21. The apparatus of claim 20, further comprising a cover moveably coupled to the at least one side.

22. The apparatus of claim 20, wherein at least one interior surface of the container comprises a material that reflects the UV light.

23. The apparatus of claim 20, coupled to a system that recirculates and disinfects air from the container using a second plurality of UV-FELs.

24. The apparatus of claim 20, configured to attach to and enclose an object selected from the group consisting of: door knob; and a light switch.

25. The apparatus of claim 19, wherein substantially all of the UV light has a wavelength in a range of 200-230 nanometers (nm).

26. The apparatus of claim 19, wherein the emitter comprises materials selected from the group consisting of: hexagonal boron nitride; gallium nitride;

aluminum nitride; aluminum gallium nitride; indium aluminum nitride; and indium aluminum gallium nitride.

27. An apparatus, comprising:

a handle; and at least one ultra-violet (UV) field-emission lamp (FEL) coupled to the handle, wherein the UV-FEL comprises:

a first plate comprising a heat-conducting material;

a second plate opposite the first plate and comprising a light-transmitting material;

an emitter comprising a source of UV light, between the first plate and the second plate;

a light-reflective material between the emitter and the first plate; and a cathode between the emitter and the second plate, wherein the cathode has openings formed therein, and wherein, in operation, the UV light from the emitter passes through the openings and through the second plate.

28. The apparatus of claim 27, wherein substantially all of the UV light has a wavelength in a range of 200-230 nanometers (nm).

29. The apparatus of claim 27, wherein the emitter comprises materials selected from the group consisting of: hexagonal boron nitride; gallium nitride; aluminum nitride; aluminum gallium nitride; indium aluminum nitride; and indium aluminum gallium nitride.

30. The apparatus of claim 27, further comprising at least one other UV-FEL moveably attached to the at least one UV-FEL.

* * * * *